US009975272B1

(12) United States Patent
Guinther

(10) Patent No.: US 9,975,272 B1
(45) Date of Patent: May 22, 2018

(54) STONE WALL CONSTRUCTION METHOD

(75) Inventor: Troy D. Guinther, Somerville, MA (US)

(73) Assignee: NATURAL STONE WALL SOLUTIONS, Concord, MA (US)

( * ) Notice: Subject to any disclaimer, the term of this patent is extended or adjusted under 35 U.S.C. 154(b) by 385 days.

(21) Appl. No.: 13/408,529

(22) Filed: Feb. 29, 2012

Related U.S. Application Data

(63) Continuation-in-part of application No. 12/431,447, filed on Apr. 28, 2009, now abandoned.

(51) Int. Cl.
*B28B 19/00* (2006.01)

(52) U.S. Cl.
CPC ..... *B28B 19/0007* (2013.01); *B28B 19/0053* (2013.01); *B28B 19/0061* (2013.01)

(58) Field of Classification Search
CPC ..... B28B 19/0061; B28B 19/0007; B28B 19/0053; B28B 19/0069; B28B 7/007
USPC ..... 264/333, 334
See application file for complete search history.

(56) References Cited

U.S. PATENT DOCUMENTS

| | | | |
|---|---|---|---|
| 985,353 | A | 2/1911 | Landis |
| 1,169,985 | A | 2/1916 | Mickelson |
| 1,211,632 | A | 1/1917 | Shaw et al. |
| 1,661,727 | A | 3/1928 | Koppelman et al. |
| 1,691,721 | A | 11/1928 | Johnson |
| 1,809,504 | A | 6/1931 | Carvel |
| 1,916,308 | A | 7/1933 | Grieco |
| 2,047,648 | A | 7/1936 | Pollard |
| 2,151,420 | A | 3/1939 | Carvel |
| 2,467,590 | A | 4/1949 | Johnson |
| 2,474,654 | A | 6/1949 | Carlson |

(Continued)

FOREIGN PATENT DOCUMENTS

| | | |
|---|---|---|
| GB | 491397 | 9/1938 |
| GB | 732431 | 6/1955 |

(Continued)

OTHER PUBLICATIONS

"Stone Wall Construction Mold and Method" Specification, Drawings, Claims and Prosecution History of U.S. Appl. No. 12/431,447, filed Apr. 28, 2009 by Troy D. Guinther, which is stored in the United States Patent and Trademark Office (USPTO) Image File Wrapper (IFW) system.

(Continued)

*Primary Examiner* — Matthew Daniels
*Assistant Examiner* — Patrick Butler
(74) *Attorney, Agent, or Firm* — Onello & Mello, LLP

(57) ABSTRACT

Provided is a system and method for building retaining and freestanding stone walls, wherein wall panels are made, then transported to an installation location, and installed on site quickly and efficiently. The wall panels are made in wall frames that use joint forms to provided wall panels having sides that reliably and securely mater together. The joint forms include "zig-zag" like connections and a structural interlocking key, engineered to prevent vertical and lateral deformation of the assembled wall. Drainage and strengthening materials are built into the wall panels while in the wall frames. A lifting apparatus is also provided that engages a wall panel through openings formed in a rear side, and stably lifts and flips the wall panel from a facedown orientation to an upright orientation.

31 Claims, 18 Drawing Sheets

(56) References Cited

U.S. PATENT DOCUMENTS

| | | | | | |
|---|---|---|---|---|---|
| 2,772,560 | A | * | 12/1956 | Neptune | 52/707 |
| 2,819,495 | A | * | 1/1958 | Krausz | 264/245 |
| 2,859,884 | A | * | 11/1958 | Pearce | E04G 21/16 182/129 |
| 3,331,175 | A | | 7/1967 | Terrio | |
| 3,441,457 | A | | 4/1969 | Regnaud | |
| 3,464,211 | A | * | 9/1969 | Andresen | E02D 29/0266 405/262 |
| 3,503,165 | A | | 3/1970 | Hardt | |
| 3,782,061 | A | | 1/1974 | Minutoli et al. | |
| 3,874,140 | A | | 4/1975 | Seehusen | |
| 4,325,575 | A | * | 4/1982 | Holt | B66C 1/666 294/89 |
| 4,555,890 | A | * | 12/1985 | Gartner | E04B 1/35 52/745.11 |
| 4,666,334 | A | * | 5/1987 | Karaus | E02B 3/04 264/33 |
| 4,771,584 | A | | 9/1988 | Beard et al. | |
| 4,907,385 | A | | 3/1990 | Biodrowski | |
| 4,915,888 | A | | 4/1990 | Sato | |
| 4,952,097 | A | | 8/1990 | Kulchin | |
| 5,017,049 | A | | 5/1991 | Sievert | |
| 5,232,646 | A | | 8/1993 | Nasvik et al. | |
| 5,410,850 | A | * | 5/1995 | Dreizler | 52/309.17 |
| 5,539,163 | A | | 7/1996 | Anderson et al. | |
| 5,624,615 | A | * | 4/1997 | Sandorff | 264/71 |
| 5,671,913 | A | | 9/1997 | Vesper | |
| 5,697,735 | A | * | 12/1997 | Egan | 405/262 |
| 5,733,470 | A | | 3/1998 | Roth et al. | |
| 5,787,666 | A | | 8/1998 | Sherry | |
| 5,839,251 | A | | 11/1998 | Weinstein | |
| 5,848,511 | A | | 12/1998 | Scales | |
| 5,957,619 | A | | 9/1999 | Kinoshita et al. | |
| 6,054,080 | A | | 4/2000 | Sheahan et al. | |
| 6,132,820 | A | | 10/2000 | Callahan | |
| 6,412,244 | B2 | | 7/2002 | Nolan | |
| 6,442,913 | B1 | | 9/2002 | Mann | |
| 6,443,666 | B1 | | 9/2002 | Smith | |
| 6,808,667 | B2 | | 10/2004 | Nasvik et al. | |
| 6,835,343 | B2 | | 12/2004 | Manthei et al. | |
| 6,854,702 | B2 | * | 2/2005 | Manthei et al. | 249/171 |
| 2004/0091317 | A1 | * | 5/2004 | Shouldice | 404/72 |
| 2005/0183360 | A1 | * | 8/2005 | Jucha et al. | 52/289 |
| 2005/0281626 | A1 | * | 12/2005 | Smith | 405/286 |
| 2006/0026919 | A1 | | 2/2006 | Morse et al. | |
| 2006/0110223 | A1 | | 5/2006 | Dawson et al. | |
| 2006/0117697 | A1 | | 6/2006 | Adam | |
| 2007/0137128 | A1 | | 6/2007 | Viau et al. | |

FOREIGN PATENT DOCUMENTS

| | | |
|---|---|---|
| WO | 02051604 | 7/2002 |
| WO | 02101174 | 12/2002 |

OTHER PUBLICATIONS

Howe, John, "Our precast paving heritage," Concrete, Jul. 2006, p. 53-55, v. 40 n. 6, Concrete Society, Camberly, Surrek, UK.

* cited by examiner

STONE WALL CONSTRUCTION METHOD

CROSS-REFERENCE TO RELATED APPLICATIONS

This application is a continuation-in-part application of U.S. patent application Ser. No. 12/431,447, entitled Stone Wall Construction Mold and Method, filed on Apr. 28, 2009 in the U.S. Patent and Trademark Office, the disclosure of which is incorporated herein in its entirety by reference.

FIELD OF INTEREST

This invention relates to the methods and systems for building stone walls, and more particularly to methods and systems for building retaining gravity walls and decorative walls built with natural stone. These stone walls are made with 100% natural bulk stone in multiple panels, include the necessary structural engineering components and are delivered and installed seamlessly giving the appearance of a natural stone wall built on site using traditional masonry practices.

BACKGROUND

Retaining walls are built to hold back earth or soil that would otherwise move or slide forward and down. There are various types of retaining walls, including gravity, piling, cantilever and anchored. Gravity walls hold the soil back mainly through their own weight and lean back into the retained soil for additional stability. Conventional gravity retaining and two-sided decorative walls made with natural stone are typically assembled and built on location.

Natural stone walls are traditionally built with or without mortar. Dry stacked (mortar-less) fieldstone walls are very popular in the New England area and are usually decorative in nature. Retaining fieldstone walls that need to be more structural in nature or withhold high earth or soil pressures are usually built with mortar. In harsher northern climates where freeze-thaw cycles are the culprits for many failed or failing retaining walls, it is even more crucial for the stone retaining wall to have proper drainage and other engineering components to ensure adequate retaining capacity.

Constructing a stone wall on location is costly, time consuming and leaves the site cluttered with piles of stone and other masonry construction materials and debris. It is also subject to weather conditions, which are unpredictable.

Some of tried to overcome some of the foregoing issues by building modular stone walls that can be include a plurality of panels built in advance, that are delivered and assembled at the site. Such modular retaining wall systems can use natural stone and various types of modular or panel systems are known for building walls (some of which are mounted or anchored onto existing structures) that attempt to imitate a natural stone wall as well as a number of wall systems of precast textured or treated concrete made to look like real stone.

Many of the prior approaches for making modular stone walls have problems when put into practice, and none address the key components of a modular wall that is completely seamless in appearance, made of natural stone, structurally and securely connected, and sufficiently made to serve as a retaining wall.

For example, in U.S. Patent No. 5,624,615, Sandorff, a method of manufacturing modular stone panels is described where stones are set in a mold and concrete is cast only on rear face of walls—leaving the outer front sides exposed between gaps resembling mortar joints. When the panel is erected, the resulting wall has the appearance of a masonry wall that was assembled stone by stone using mortar. This method uses embedded coil-threaded structures and reinforcing rods to lift and join the panels together. The resulting wall does not come together seamlessly (e.g., has clearly visible vertical joints) and requires cap plates to hide the top of the wall, which is exposed concrete. The weep holes created by rods are not connected to anything and in reality, become blocked with loose dirt and soil almost instantly rendering them useless in dissipating groundwater to prevent hydrostatic pressure buildup. Furthermore, in practice, the coil-threaded rods are not strong enough to safely lift and flip upright (without damage to the stone face of the wall) an extremely heavy wall panel that would weigh around 200 lbs (90 kg) per square foot. In practice, walls lifted as described in this patent would hang at about a 30 degree angle and could not be lowered vertically into adjacent panels as required. Also, given the weight of each wall panel and difficulty maneuvering the same, to perfectly align and join wall panels using the "tongue and groove" system described is impossible in practice.

In patent application publication US 2005/0281626, to Smith, disclosed is a floating natural mortared stone modular wall and method for constructing the same. This system does not address aesthetic or structural requirements for a natural stone retaining wall and will also have visible vertical seams at each wall panel connection. And the resulting wall will need to have an exposed concrete top since the system allows each wall panel to move independently of one another in a vertical motion and has no structural engineering components, such as drainage required for a gravity retaining wall.

SUMMARY

The present invention addresses the aesthetic and structural shortcomings of prior modular retaining wall systems and the cost, timing and mess of traditional masonry wall construction.

This invention produces natural stone walls that have no visible seams or joints of typical modular systems, possess the exceptional beauty and quality of natural stone that cannot be replicated with any other building material, are structurally engineered to outlast any traditionally built stone wall, and provide drastic efficiencies in construction and installation time. The process used in this invention also allows for complete customization of each wall design. Any type of natural stone can be used. Mortar look or finish can be specified, including a dry tucked or mortar less appearance or exposed mortar finish.

Wall segments in this invention can have zig-zag connections and negative voids for on-site bridge stone placement to hide any appearance of a vertical joint—to meet the aesthetic requirements for a seamless natural stone wall. The zig-zag joints and structural interlocking keys further meet structural requirements for additional shear strength and acceptable movements from differential settling and prevent vertical and lateral deformation of the resulting wall. Pre-installed drainage and geogrid components can be included to further address retaining wall engineering requirements.

Methods in accordance with this invention can also be used to build two-sided or freestanding natural stone walls. A freestanding wall can be made when two walls built as described herein are placed back-to-back. In such as case, wall segments can be made thinner in the case a retaining wall (which need only have one finished side) Additionally, no drainage is required and additional blocking members (e.g., Styrofoam) can be placed into the forms to create negative voids/spaces for top joint bridge stones. The resulting freestanding wall has no visible vertical joints and the top of the wall preferably has a natural stone finish, so does not require a cap.

In accordance with one aspect of the present disclosure, provided is a wall frame useful to construct a natural stone wall. The wall frame comprises a face portion, a frame top, a frame bottom opposite the frame top, and at least two frame ends, collectively arranged to form an open box having an open back and at least one joint form, wherein a joint form can be used as a frame end or a divider of the open box. Each joint form includes: a first side configured to define a first non-straight pattern in a first stone wall panel constructed within the wall frame, wherein the first non-straight pattern is configured to mate with a second non-straight pattern of an adjacent second stone wall panel defined by a second joint form; and a first structural interlocking key component pattern configured to form a first interlocking key void in the first stone wall panel, wherein the first interlocking key void is configured to align with a second interlocking key void of the adjacent second stone wall panel defined by the second joint form to define a single combined void when the first and second stone wall panels are abutted.

In various embodiments, the wall frame can further comprise at least one wedge configured to be inserted between two adjacent joint forms arranged side-by-side within the open box of the wall frame.

In various embodiments, the wall frame can further comprise joint form holders configured to secure the joint forms within the wall frame to divide the open box.

In various embodiments, the joint forms can be secured to or part of the frame top and frame bottom.

In various embodiments, the wall frame can further comprise at least two flared tie loops connected to the frame top.

In various embodiments, the first non-straight pattern and second non-straight patterns can be matching zig-zag patterns.

In accordance with another aspect of the invention, provided is a method of forming at least one wall panel for a natural stone wall. The method comprises: providing a wall frame as a box having an open, the wall frame having a face portion, a frame top, a frame bottom opposite the frame top, and at least two frame ends, including placing the wall frame in a facedown position. The method also includes: inserting at least one joint form into the wall frame, wherein each joint form is configured to form a non-straight end pattern in a wall panel constructed in the wall frame; inserting removable placeholders against the face portion and the at least one joint forms; layering a sand setting bed onto the face portion and around the placeholders; layering natural stones onto the sand setting bed; filling the wall frame with cement; after curing of the cement, removing the wall panel from the wall frame; and removing the placeholders from a face of the wall panel.

In various embodiments, the method can further comprise inserting at least one drain pipe into the sand setting bed prior to layering the natural stones, the drain pipe extending from the face of the wall panel to at least the open back of the box.

In various embodiments, the method can further comprise attaching a drainage system to the at least one drain pipe.

In various embodiments, the method can further comprise layering reinforcement materials on the natural stones before filling the wall frame with cement.

In various embodiments, the method can further comprise submerging a portion of a geotextile or geogrid fabric into the cement before the cement cures, the geotextile or geogrid fabric extending beyond a rear face of the wall panel after the curing of the cement.

In various embodiments, the method can further comprise setting lifting tubes into the cement before curing, such that the lifting tubes are accessible from a rear face of the wall panel after the curing of the cement.

In various embodiments, the method can further comprise removing the wall panel from the wall frame, including inserting a lifting apparatus into the lifting tubes and applying a substantially vertical force on the lifting apparatus that simultaneously lifts and flips upright the wall panel from the face down position.

In various embodiments, the method can further comprise temporarily anchoring flared tie loops to the frame top, prior to layering the natural stones.

In various embodiments, the joint forms can comprise a first structural interlocking key component pattern configured to form a first interlocking key void in the wall panel, wherein the first interlocking key void is configured to align with a second interlocking key void of an adjacent second stone wall panel to define a single combined void when the first and second stone wall panels are abutted.

In various embodiments, the method can further comprise inserting a wedge adjacent to the at least one joint form and contouring the sand setting bed into a concave shape to form a convex wall panel.

In various embodiments, the method can further comprise inserting a wedge adjacent to the at least one joint form and contouring the sand setting bed into convex a shape to form a concave wall panel.

In various embodiments, the non-straight pattern can be a zig-zag pattern.

In accordance with another aspect of the invention, provided is a method of forming a natural stone wall The method comprises forming a plurality of stone wall panels, which includes: providing a wall frame as a facedown box having an open back, the wall frame having a face portion, a frame top, a frame bottom opposite the frame top, and at least two frame ends; and inserting at least two joint forms into the wall frame to divide the wall frame into sub-frames, the at least two joint forms including a first joint form configured to define a first non-straight pattern in a first end of a first stone wall panel constructed within a first sub-frame and a second joint form configured to define a second non-straight pattern in a second end of a second stone wall panel constructed within a second sub-frame, wherein the first end of the first non-straight pattern is configured to mate with the second end of the second non-straight pattern of the second stone wall panel when abutted; inserting removable placeholders in the first and second sub-frame on opposite sides of the first and second joint forms and against the face portion, to form one or more bridge stone voids across a vertical joint of the first and second wall panels when abutted; layering a sand setting bed onto the face portion and around the placeholders in the first and second sub-frames; layering natural stones onto the sand setting bed in the first and second sub-frames; and filling the first and second sub-frames with cement. After curing of the cement, the method further includes removing the first and second wall panels from the first and second sub-frames; removing the placeholders, from faces of the first and second wall panels; transporting the first and second wall panels to an installation location; at the installation location, abutting the first end of the first wall panel with the second end of the second wall panel; and inserting bridge stones in voids left by the removed placeholders, to at least partially cover the vertical joint between the first and second wall panels.

In various embodiments, the method can further comprise, in each sub-frame, inserting at least one drain pipe into the sand setting bed prior to layering the natural stones, the drain pipe extending from the face of the wall panel to at least the open back of the box.

In various embodiments, the method can further comprise attaching a drainage system to the at least one drain pipe.

In various embodiments, the method can further comprise, in each sub-frame, layering reinforcement materials on the natural stones before filling the sub-frame with cement.

In various embodiments, the method can further comprise, in each sub-frame, submerging a portion of a geotextile or geogrid fabric into the cement before the cement cures, the geotextile or geogrid fabric extending beyond a rear face of each wall panel after the curing of the cement.

In various embodiments, the method can further comprise, in each sub-frame, setting lifting tubes into the cement before curing, such that the lifting tubes are accessible from a rear face of the wall panel after the curing of the cement.

In various embodiments, removing the first and second wall panels from the first and second sub-frames can comprise, for each wall panel: inserting a lifting apparatus into the lifting tubes and applying a substantially vertical force on the lifting apparatus that simultaneously lifts and flips upright the wall panel from the face down position.

In various embodiments, the method can further comprise, in at least one sub-frame, temporarily anchoring flared tie loops to the frame top, prior to layering the natural stones.

In various embodiments, the first and second joint forms can comprise a first structural interlocking key component pattern configured to form a first interlocking key void in the first wall panel and a second interlocking key void in the second wall panel, wherein the first interlocking key void is configured to align with the second interlocking key void to define a single combined void when the first and second wall panels are abutted.

In various embodiments, the first and second joint forms are back-to back, and the method can further comprise inserting a wedge between the first and second joint forms and contouring the sand setting bed in at least one or the first and second sub-frames into a concave shape to form a convex wall panel.

In various embodiments, the first and second joint forms are back-to back, and the method can further comprise inserting a wedge between the first and second joint forms and contouring the sand setting bed in at least one or the first and second sub-frames into a convex shape to form a concave wall panel.

In various embodiments, the non-straight pattern can be a zig-zag pattern.

In various embodiments, the method can further comprise: forming a third panel in a third sub-frame using a third joint form that is substantially the same as the first joint form; forming a fourth panel in a fourth sub-frame using a fourth joint form that is substantially similar to the second joint form; in each of the first, second, third, and fourth sub frames, inserting removable top placeholders against the face portion and at the top frame, to form one or more bridge stone voids across top joints of the first and third wall panels when abutted back-to back and top joints of the second and fourth wall panels when abutted back-to back. The method can further comprise, after curing of the cement: removing the third and fourth wall panels from the third and fourth sub-frames; removing the top placeholders, from the first, second, third and fourth wall panels; transporting the third and fourth wall panels to the installation location; at the installation location, abutting a first back of the first wall panel with a third back of the third wall panel, abutting a second back of the second wall panel with a fourth back of the fourth wall panel, and abutting a third end of the third wall panel with a fourth end of the fourth wall panel; and inserting bridge stones in voids left by the removed placeholders, to at least partially cover the joint between the first and third wall panels and second and fourth wall panels.

BRIEF DESCRIPTION OF THE DRAWINGS

The present invention will become more apparent in view of the attached drawings and accompanying detailed description. The embodiments depicted therein are provided by way of example, not by way of limitation, wherein like reference numerals refer to the same or similar elements. The drawings are not necessarily to scale, emphasis instead being placed upon illustrating aspects of the invention. In the drawings.

DETAILED DESCRIPTION OF PREFERRED EMBODIMENTS

Figure 1:
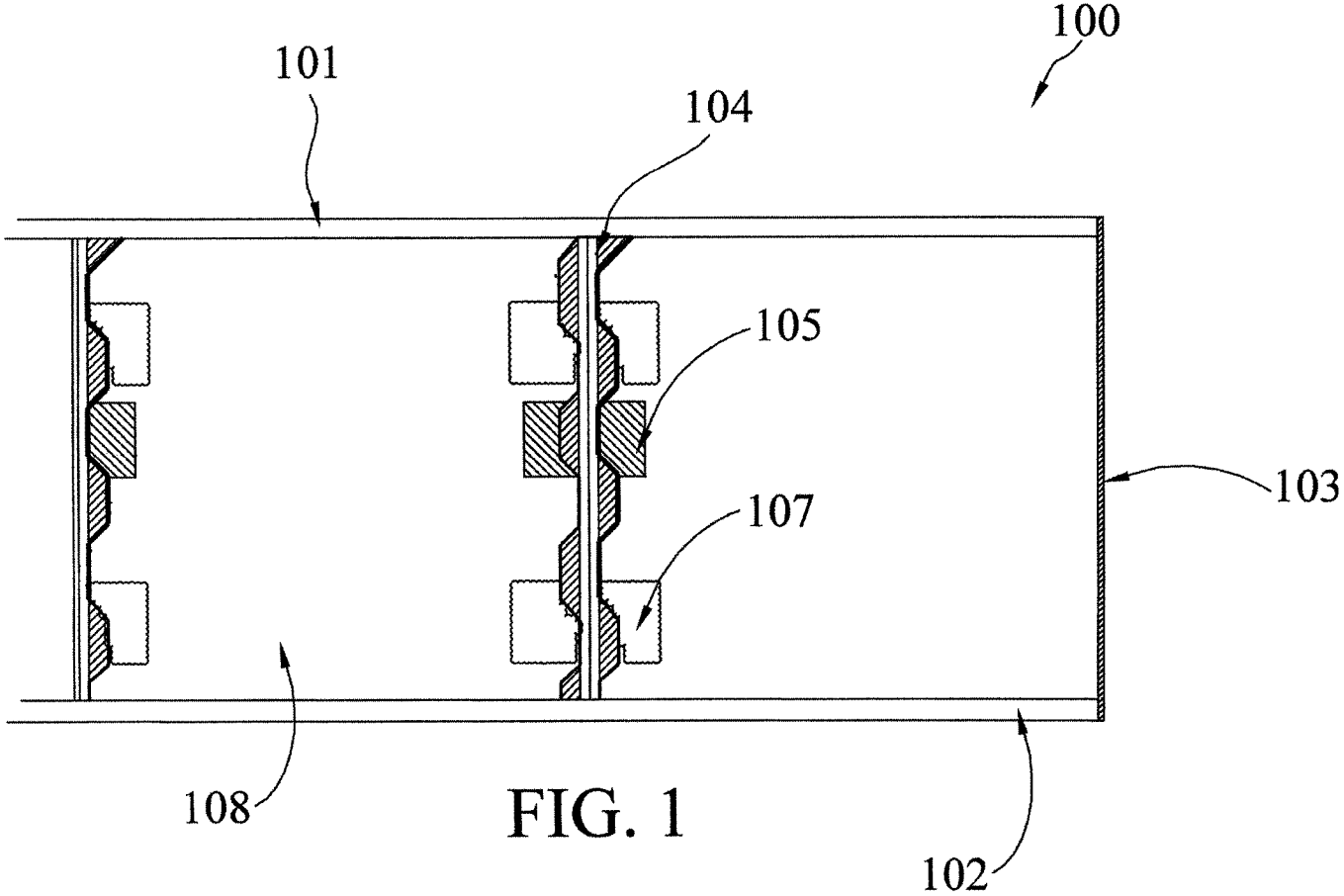
FIG. 1 is a top view of an embodiment of a wall frame, in accordance with aspects of the present invention.

Various exemplary embodiments will be described more fully hereinafter with reference to the accompanying drawings, in which some exemplary embodiments are shown. The present inventive concept may, however, be embodied in many different forms and should not be construed as limited to the exemplary embodiments set forth herein.

It will be understood that, although the terms first, second, etc. are be used herein to describe various elements, these elements should not be limited by these terms. These terms are used to distinguish one element from another, but not to imply a required sequence of elements. For example, a first element can be termed a second element, and, similarly, a second element can be termed a first element, without departing from the scope of the present invention. As used herein, the term "and/or" includes any and all combinations of one or more of the associated listed items.

It will be understood that when an element is referred to as being "on" or "connected" or "coupled" to another element, it can be directly on or connected or coupled to the other element or intervening elements can be present. In contrast, when an element is referred to as being "directly on" or "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, steps, operations, elements, and/or components, but do not preclude the presence or addition of one or more other features, steps, operations, elements, components, and/or groups thereof.

Exemplary embodiments are described herein with reference to cross-sectional illustrations that are schematic illustrations of idealized exemplary embodiments (and intermediate structures). As such, variations from the shapes of the illustrations as a result, for example, of manufacturing techniques and/or tolerances, are to be expected. Thus, exemplary embodiments should not be construed as limited to the particular shapes of regions illustrated herein but are to include deviations in shapes that result, for example, from manufacturing.

In accordance with aspects of the present invention, provided are methods and systems for building stone walls, and more particularly methods and systems for building retaining gravity walls and decorative walls built with natural stone. Such stone walls are preferably made with 100% natural bulk stone in multiple sections, include the necessary structural engineering components, and are delivered and installed seamlessly giving the appearance of a natural stone wall built on site using traditional masonry practices.

A. Retaining Walls

Wall Frames, Joint Forms, and Placeholders

FIG. 1 is a top view of an embodiment of wall frames 100 having a face 108 on the ground, and showing the perimeter frames with frame top 101, frame bottom 102 and frame ends 103, joint forms 104 with the structural interlocking key component 105 and placeholders 107 (e.g., Styrofoam blocks) for later addition of a bridge stone. In this embodiment, there two frame ends 103 (only one is shown) that forms a box with frame top 101, opposing frame bottom 102 and face 108, where a rear side of the box is open for placement of frame construction materials. Joint forms are insertable within the wall frame box, as discussed below. To accommodate insertion, the top frame 101 and bottom frame 102 can comprise joint form holders, e.g., channels configured to slideably receive top and bottom ends of the joint forms 104.

Wall frames are built and arranged based on specified design, height and curvature requirements of each wall. Wall frames 100 include, in this embodiment, a perimeter frame (comprising frame top 101, frame bottom 102, and frame ends 103, joint forms 104 having a structural interlocking key component 105, which are determined and built based on wall design requirements, and a face 108.

In FIG. 1, the wall frame face 108 is positioned facedown on a substantially level surface and perimeter frames (including frame top 101, frame bottom 102 and frame ends 103) are laid out. Then joint forms 104 with structural interlocking key component 105 are inserted at pre-determined locations within the wall frame 100—per wall design. Joint forms 104 address the structural and aesthetic requirements for a resulting seamless appearance in a natural stone retaining wall. That is, the wall frames 100 can be constructed such that there are a plurality of options for inserting the joint forms 104.

In this embodiment, the joint forms 104 include "zig-zag" like connections and the structural interlocking key 105 that is part of the joint form are engineered to prevent vertical and lateral deformation of the retaining wall. In various embodiments, joint forms 104 and wall frame ends 103 include a minimum of 5° or 1:20 batter setback 106 for increased stability of the wall to be leaning back into the retained soil, which is shown as being about 85 degrees from the ground surface and or face 108. Aesthetically, the zig-zag like connections of the joint forms 104 and the field-set bridge stones help eliminate any appearance of a vertical joint. That is, the placeholders 107 (e.g., Styrofoam) are removed after forming the retaining wall, and on-site stones are set into the recesses or cavities left by the removed placeholders 107, as discussed later.

Placeholders 107 (e.g., Styrofoam or other similar impenetrable and removable blocking material) can be used to reserve space within the wall, by defining a cavity when later removed, for later installed bridge stones. The placeholders 107, and can be placed inside the wall frame adjacent to the joint forms where field-set bridge stones will be later be placed.

Sand, Drainage and Curves

Figure 2:
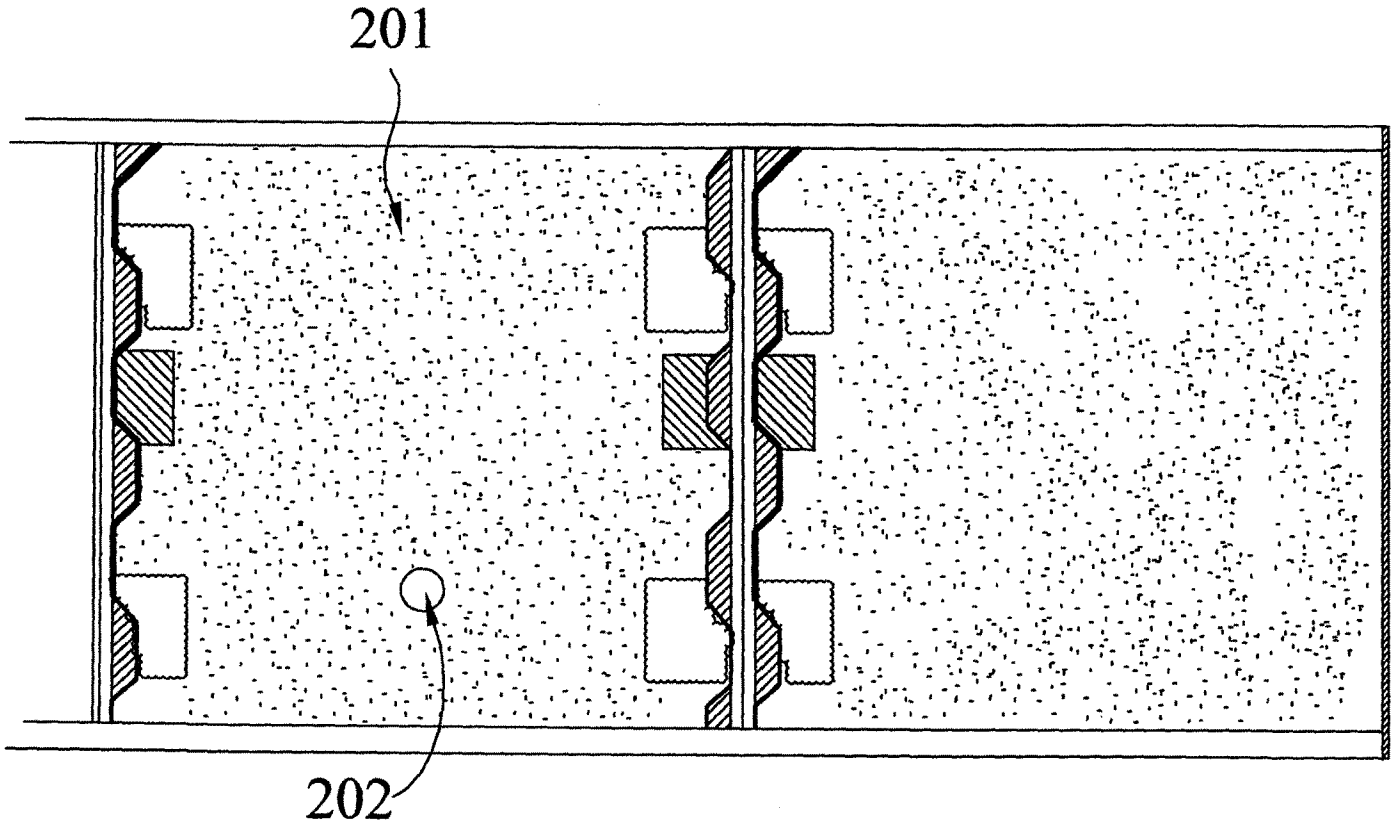
FIG. 2 is a top view of an embodiment of the wall frame of FIGS. 1 and 1A having a sand setting bed and drainage pipe, in accordance with aspects of the present invention.
Figure 2A:
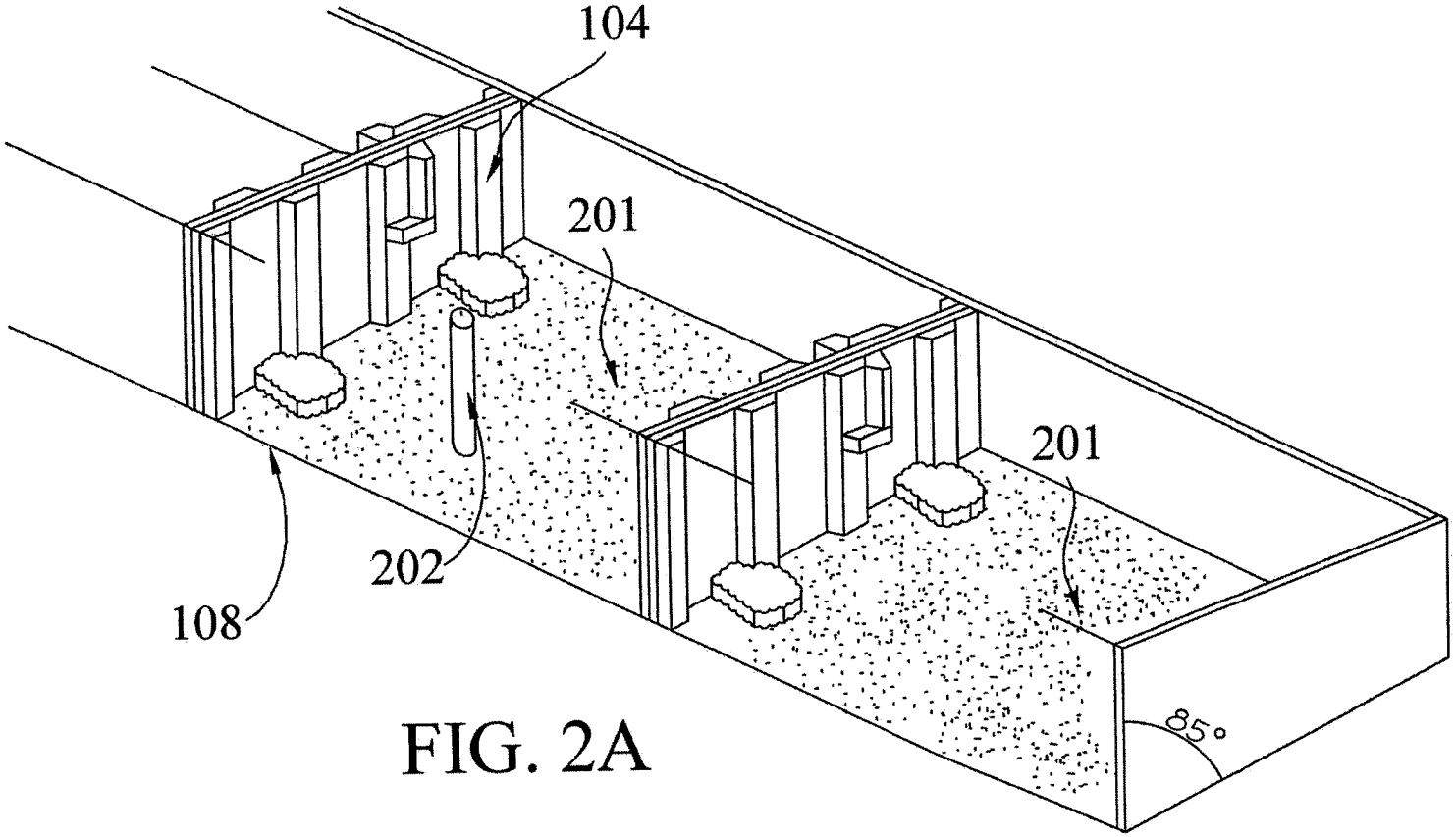
FIG. 2A is an isometric view of an embodiment of the wall frame of FIG. 2 having a sand setting bed and drainage pipe, in accordance with aspects of the present invention.

FIG. 2 is a top view of the wall frames discussed above, again laying on the ground (as a substantially level surface), showing sand 201 as a sand-setting bed and drainage pipes 202 set within the wall frames. FIG. 2A provides an isometric view of the wall frames on the ground showing the sand 201 for sand-setting bed and drainage pipes 202.

Figure 2B:
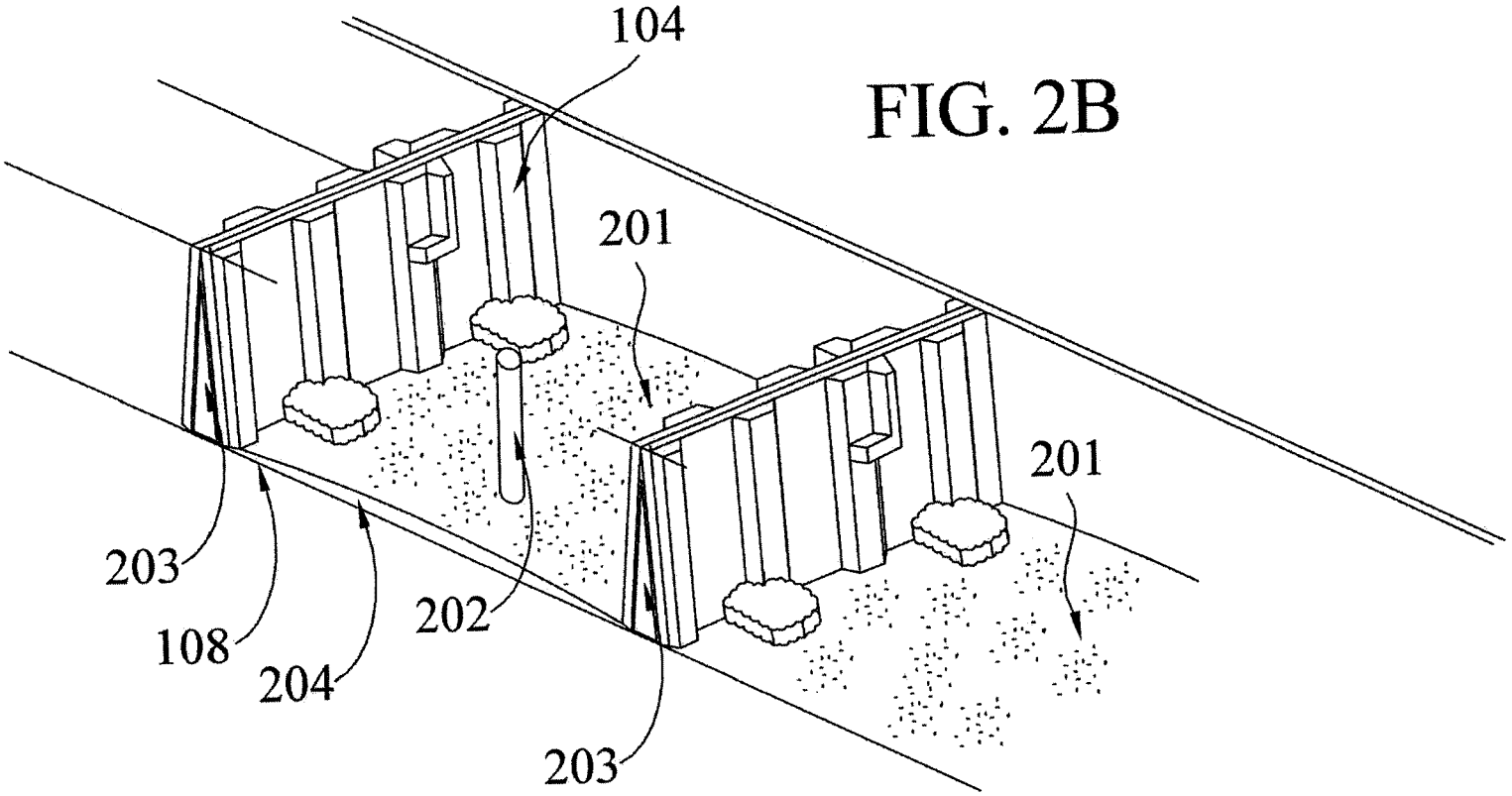
FIG. 2B is an isometric view of an embodiment of the wall frame of FIGS. 2 and 2A having a sand setting bed, drainage pipe, and wedges to create a predetermined concave wall curve, in accordance with aspects of the present invention.

FIG. 2B is an isometric view of wall frames for walls with resulting concave curves showing use of wedges 203 and screed sand deflection 204 used for curve creation—to enable creation of a curved wall, in accordance with the present invention. And FIG. 2C is an isometric view of wall frames for walls with resulting convex curves showing the wedges 203 and screed sand deflection 205 used for curve creation, in accordance with the present invention.

In the foregoing figures, sand (or an equivalent) is placed inside the wall frames (comprising 101, 102, 103 and 104) on face 108 and screeded (i.e., substantially leveled) to a predetermined depth to form a sand setting bed 201, as indicated by the wall design and on required stone type. This results in a sand setting bed 201 that is generally level in the forms, which provides a surface upon which the stones will ultimately be placed.

Figure 2C:
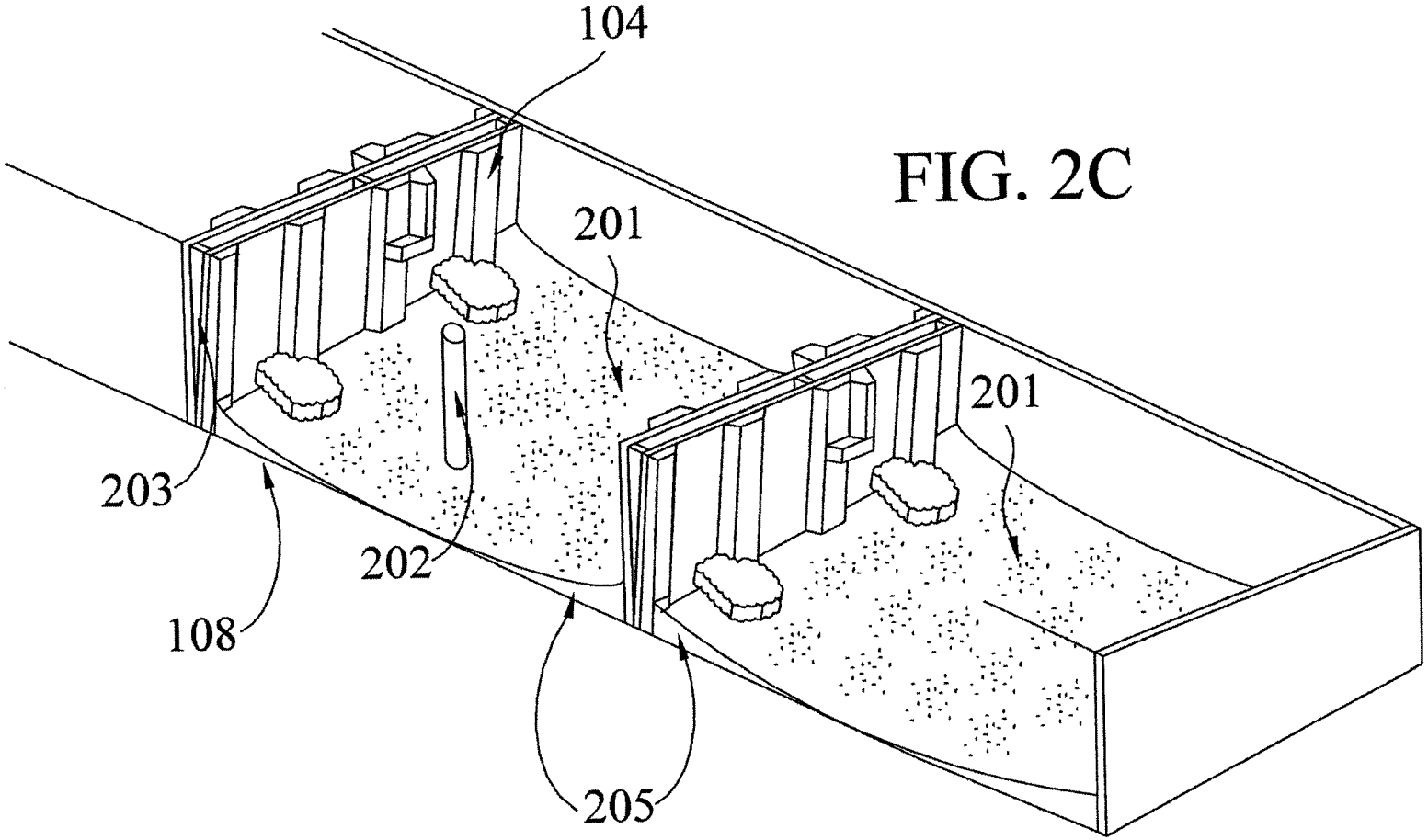
FIG. 2C is an isometric view of an embodiment of the wall frame of FIGS. 2 and 2A having a sand setting bed, drainage pipe, and wedges to create a predetermined convex wall curve, in accordance with aspects of the present invention.

For curved walls, as in FIGS. 2B and 2C, after setting sand in the wall frame so that is substantially level, wedges 203 are inserted between joint forms 104. The screeded sand setting bed 201 is raked out to the proper radius, based on the required concave or convex curve of the wall. The wall frame will eventually get flipped up, at which point the wall panel will have a curve to it. The wedges ensure that the wall panel has a joint that is perpendicular to the curve so that the wall panel fits correctly to next piece.

The deflection for the curve or the curve radius of a wall panel may be concave 204 or convex 205, depending on design requirements. Wedges 203 are used to create a perpendicular angle of the joint forms 104 with respect to the curve of the wall, and also the radiused screeded sand setting bed 201. The radiused sand setting bed is shaped to achieve the specified curves 204 and 205 of the wall panel, depending in the direction of wedges 203. Wedge size and orientation along with the radiused screeded sand determines the curve radius for the wall. For example, a 6 inch wedge produces a 14 degree angle between joint forms, wherein 6" is the width of the bottom of the wedge. Inserting a 6" wedge into the joint forms along with a 5 inch deflection of screed sand in an 8 foot wall panel, results in a 22 foot radius curved wall panel. To produce smaller curve radii, the wedge size and deflection angles are increased.

Drainage pipes 202, e.g., made of 2" PVC conduit or other material, are placed into the sand setting bed 201, based on design and engineering requirements of wall under construction, to create "weep holes" to be later connected. In this embodiment, the 2" conduit is placed at 85 degrees from level to the base so that the face of the conduit is recessed 3" from the face of the resulting stone wall and has a slight pitch so that it will always drain. Here, the pipe is cut so that the back of the conduit extends at least 4" past the concrete backing to be later added.

Stones, Rebar and Concrete

Figure 3:
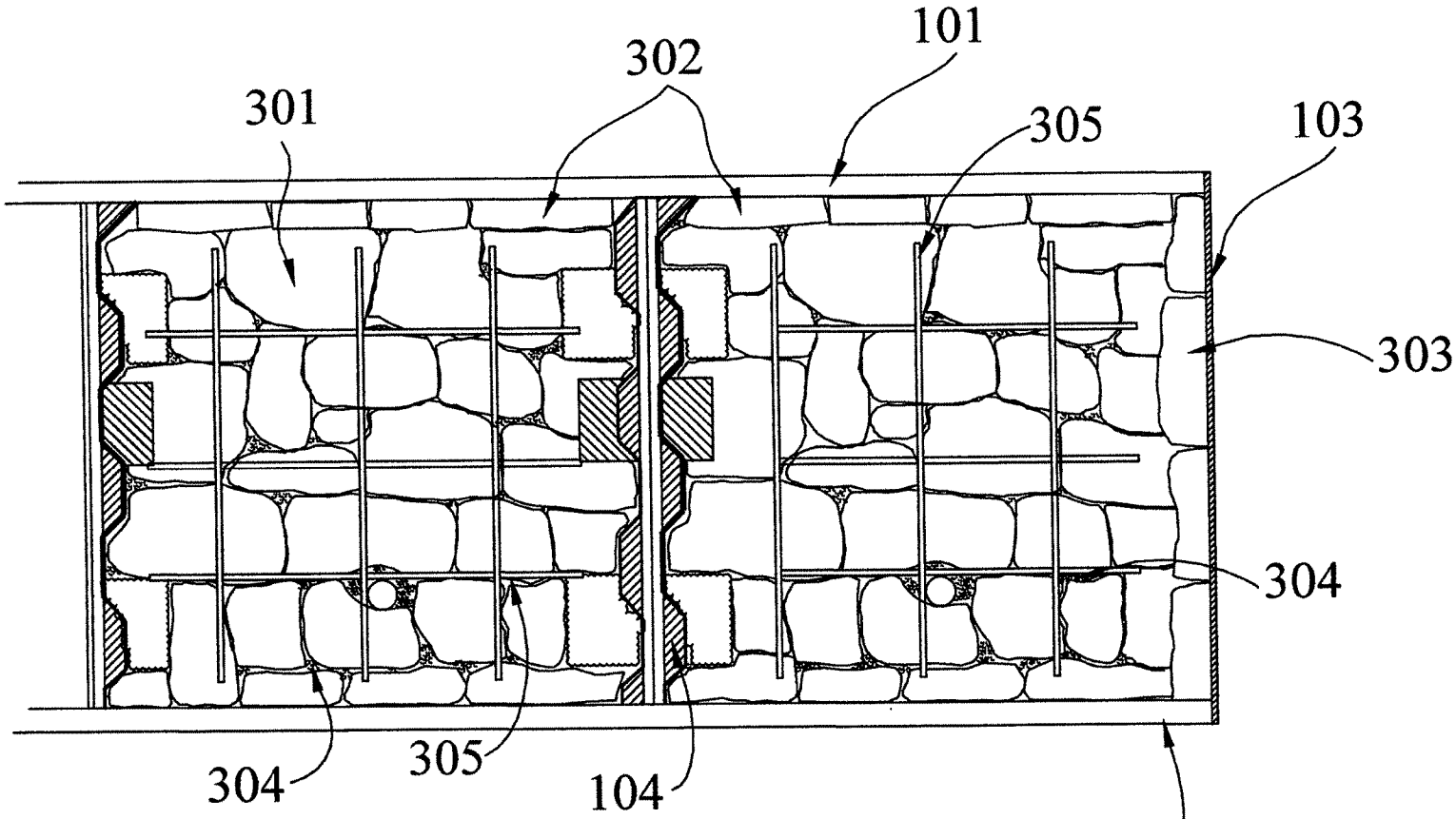
FIG. 3 is a top view of an embodiment of the wall frame of FIGS. 2 and 2A having stones and reinforcements added, in accordance with aspects of the present invention.
Figure 3A:
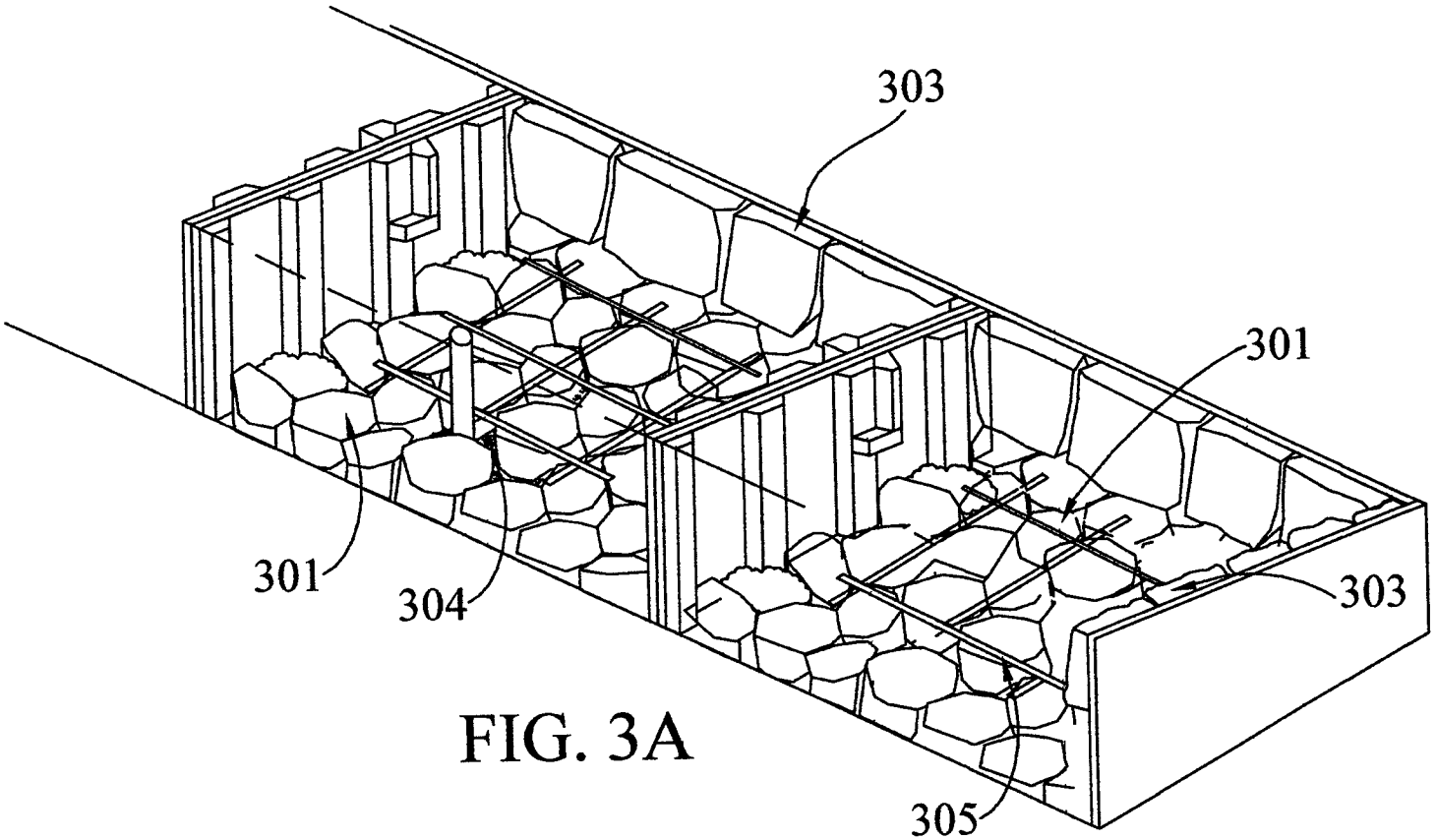
FIG. 3A is an isometric view of an embodiment to the wall frame of FIG. 3 having stones and reinforcements added, in accordance with aspects of the present invention.

FIG. 3 is a top view of an embodiment to the wall frame of FIGS. 2 and 2A having stones and reinforcements added, in accordance with aspects of the present invention. And FIG. 3A is an isometric view of an embodiment to the wall frame of FIG. 3 having stones and reinforcements added, in accordance with aspects of the present invention.

For natural stones, face stones 301, top stones 302 and side stones 303 are placed into the sand setting bed 201 inside the wall frames 100, as required by the wall design. Face stones 301 are arranged in the sand setting bed to create the face or front of the resulting wall, top stones 302 are arranged against the frame top 101 to a create natural wall top. For end wall panels, side stones 303 are arranged against the frame ends 103.

Sand 304 is carefully placed and swept into the joints between the stones per wall design (e.g., dry tucked vs. exposed mortar appearance). Sand in stone joints 304 is washed down and compacted with water to further ensure that the natural joints between stones are even and that the back of each stone is clean to ensure proper adhesion with the concrete to be placed later.

Reinforcing members are added, and will ultimately located within the wall when complete. In this embodiment, the reinforcing members take the form of a steel grid consisting of #4 rebar rods 305 is placed on top of the face stones 301 and will serve to strengthen and reinforce the concrete to be placed later on.

Concrete, Geogrid and Lifting System

Figure 4:
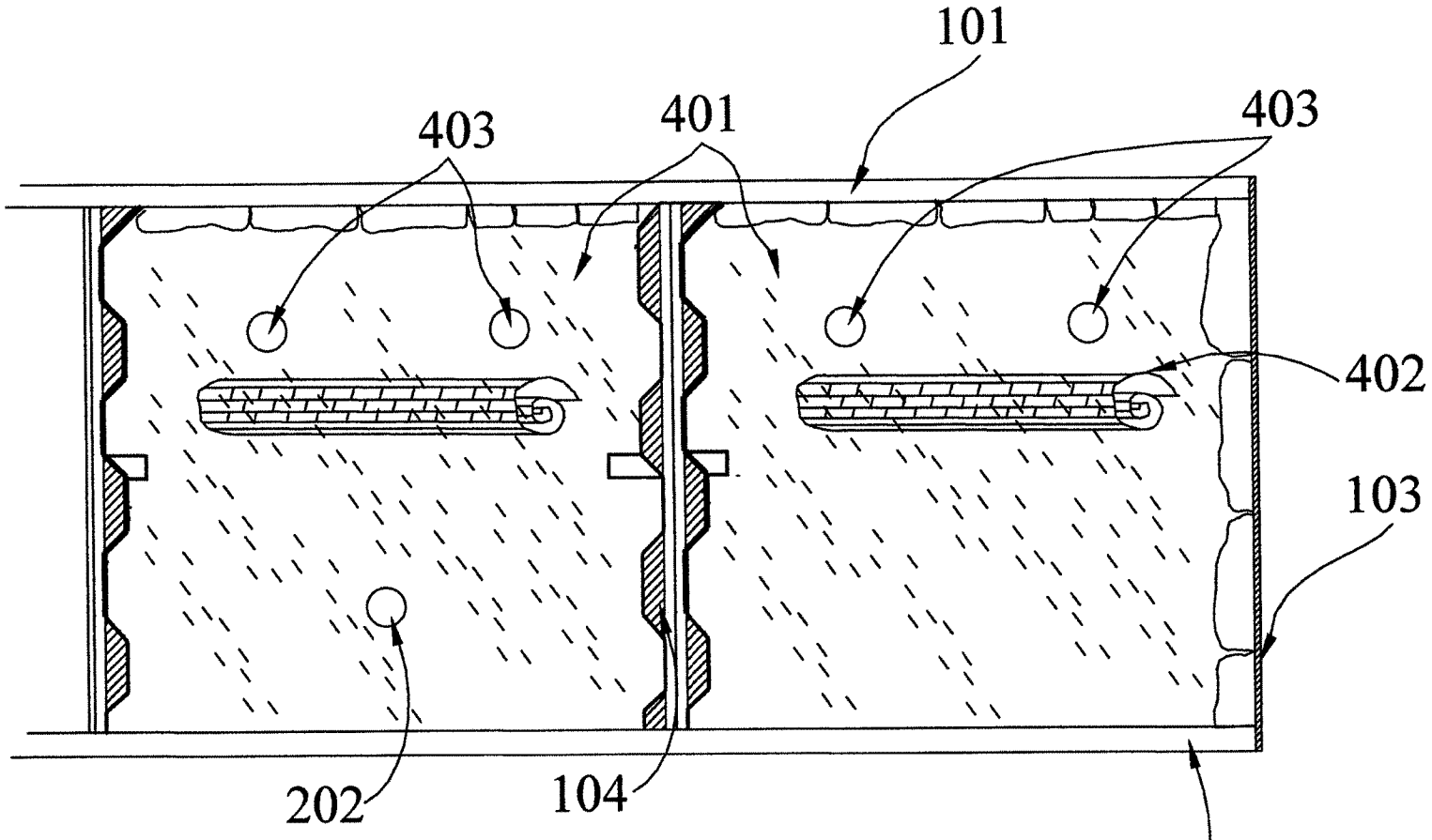
FIG. 4 is a top view of an embodiment to the wall frame of FIGS. 3 and 3A having concrete, geogrid, and a lifting system added, in accordance with aspects of the present invention.
Figure 4A:
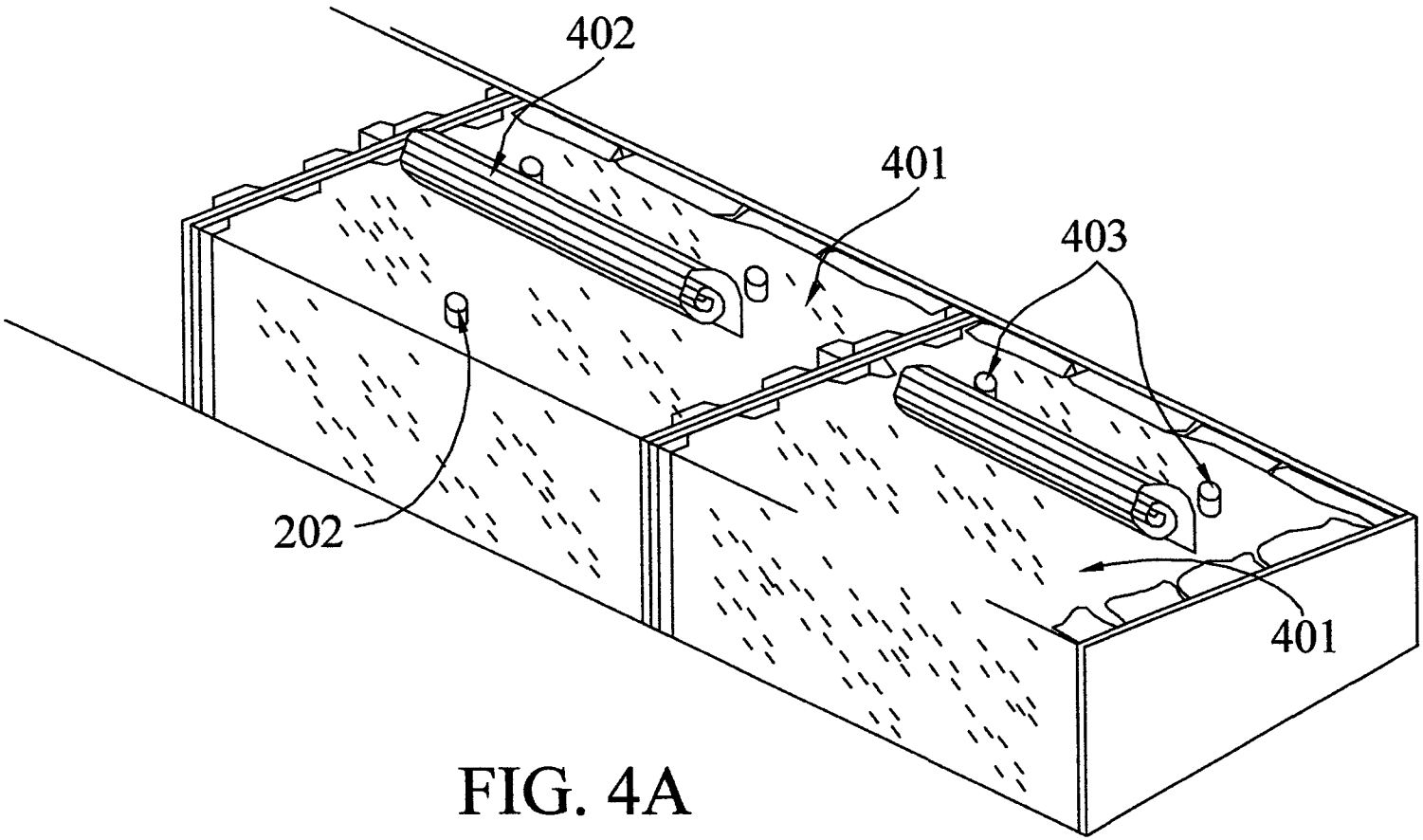
FIG. 4A is an isometric view of an embodiment to the wall frame of FIG. 4 having concrete, geogrid, and a lifting system added, in accordance with aspects of the present invention.

FIG. 4 is a top view of an embodiment to the wall frame of FIGS. 3 and 3A having concrete, geogrid, and a lifting system added, in accordance with aspects of the present invention. And FIG. 4A is an isometric view of an embodiment to the wall frame of FIG. 4 having concrete, geogrid, and a lifting system added, in accordance with aspects of the present invention.

In this embodiment, a 3000-PSI concrete is placed onto the face stones 301 and rebar rods 306 to a depth of at least 12 to 18 inches to create the concrete backing 401 of resulting walls. Simultaneously with concrete placement (i.e., at least before the curing process is complete), geotextile fabric or geogrid 402 is anchored into the wet concrete according to design and engineering requirements of walls and will function as reinforcement for the soil behind the wall. The geogrid 402 is later cut to the appropriate length requirement for the particular wall height and soil conditions, and is used to tie the wall into the earth.

Also simultaneously with concrete placement (i.e., at least before the curing process is complete), lifting tubes 403, e.g., formed from 2" schedule 40 PVC conduit pipes with one sealed end, are inserted at least 8 inches into the wet concrete backing 401 of each wall section (or panel) and will serve as insert holes for a lifting apparatus, in this embodiment. Sealing the end prevents concrete from filling the lifting tubes 403.

A concrete vibrator can be used to ensure a proper concrete consolidation and adhesion to the stones in the forms. The consolidated concrete that forms the reinforced concrete backing 401 of the walls is then left to cure in the forms for the required proper curing time, as specified by concrete manufacturer.

Wall Reveal, Load and Transport

Figure 5:
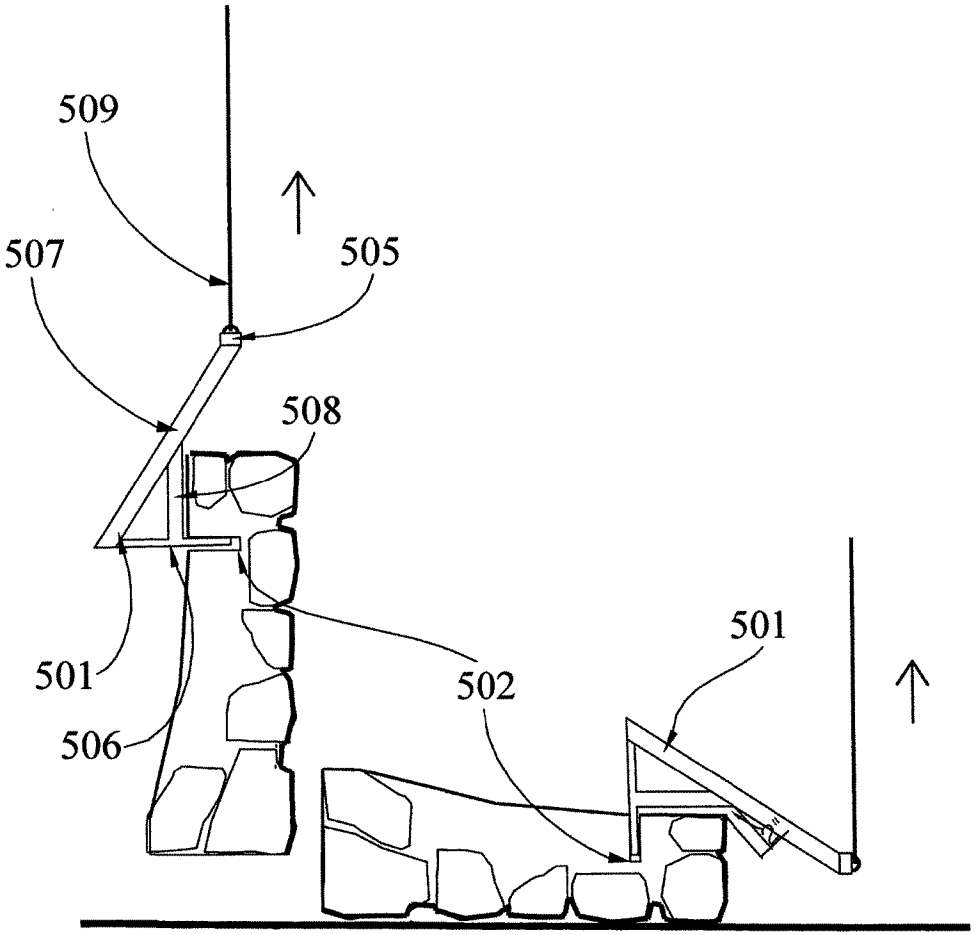
FIG. 5 is a side view of a wall panel or section being lifted using a lifting apparatus, in accordance with aspects of the present invention.

FIG. 5 is a side view of a wall panel or section being lifted using a lifting apparatus, in accordance with aspects of the present invention. After concrete has fully cured (see FIGS. 4 and 4A), the perimeter frame (comprising frame top 101, frame bottom 102 and frame ends 103) is removed to reveal the stone wall panels. A lifting apparatus 501 is inserted into the pre-installed insert holes 502, also referred to as lifting tubes 403 in FIGS. 4 and 4A.

Figure 6:
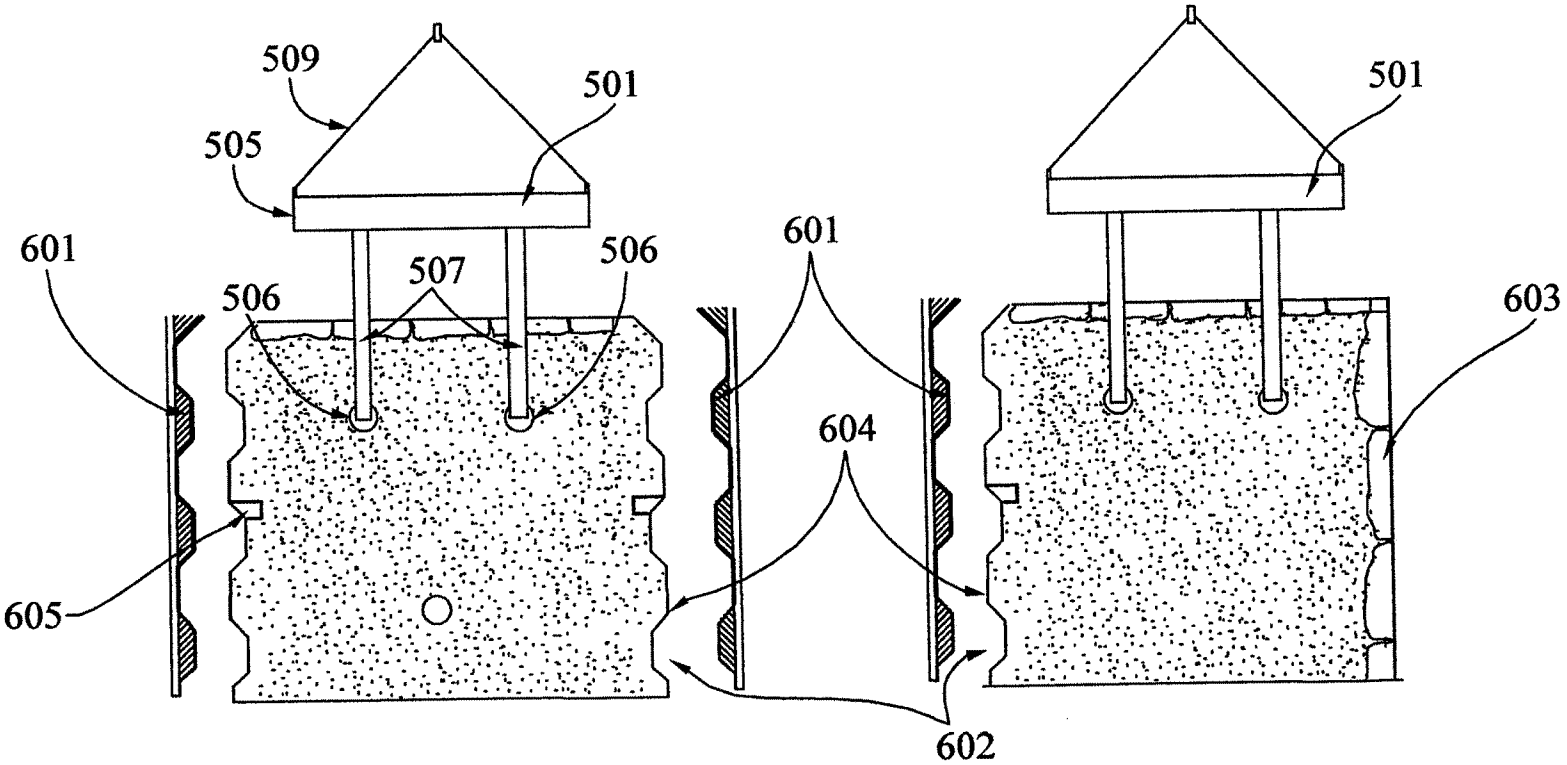
FIG. 6 is a top view of two wall panels, including an end panel, being lifted using the lifting apparatus of FIG. 5, in accordance with aspects of the present invention.

FIG. 5 provides a side view of the lifting apparatus 501 and FIG. 6 provides a rear view of the lifting apparatus 501. The lifting apparatus 501 include a crossbar 505 having two eyelets attached thereto, to accommodate connection to a cable 509. Extending downwardly from the crossbar 505 are two angled top holder members 507 and angled bottom holder member 506. Each top holder member 507 and its respective bottom holder member 506 are connected by a bridging member 508. To facilitate good holding of a wall panel when lifted by a lifting apparatus, the bottom holding member 506 has an angle less than 90 degrees with respect to the bridging member 508, wherein bridging member 508 will be substantially parallel to the wall panel being lifted. The lifting apparatus 501 is made from a strong, rigid material, e.g., steel, so that is sufficient strong to lift a wall panel.

To lift and flip the wall panel, the bottom holding members of the lifting apparatus 501 are inserted into the pre-installed insert holes 502. The lifting apparatus 501 is attached to a crane or similar equipment (via cable 509) that lifts and flips each wall panel so that the front of the wall becomes exposed. That is, as the cable is vertically raised, the shape, strength and rigidity of the lifting apparatus causes the wall panel to be flipped from the facedown position (on the right in FIG. 5) to an upright position (on the left on FIG. 5).

Figure 6A:
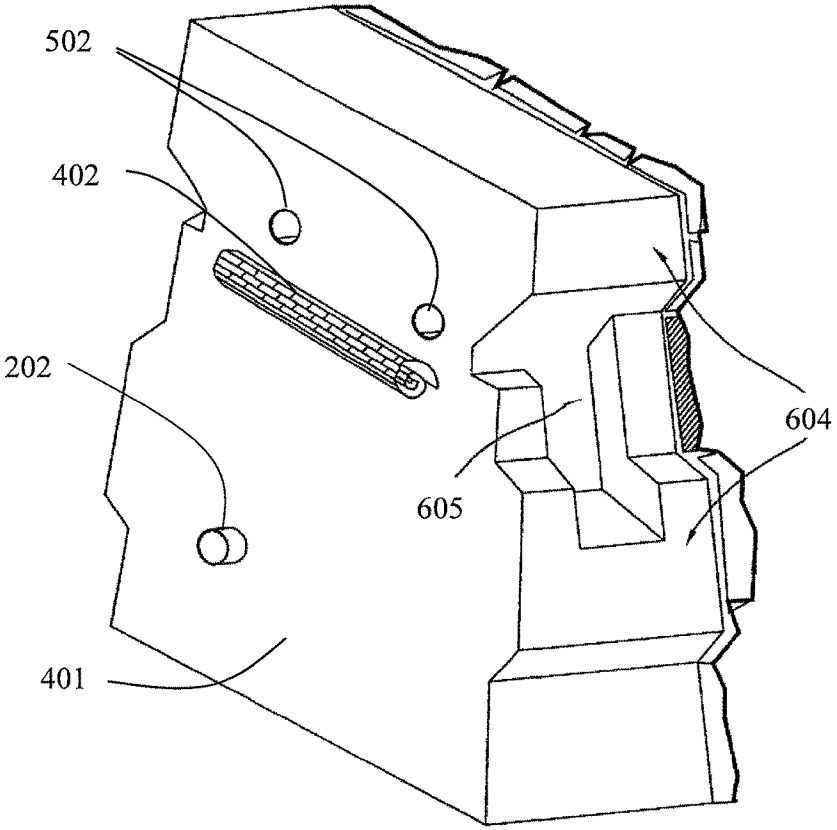
FIG. 6A is an isometric view of a wall panel from FIG. 6, in accordance with aspects of the present invention.

FIG. 6 is a top view of two wall panels, including an end panel, being lifted using the lifting apparatus of FIG. 5, in accordance with aspects of the present invention. FIG. 6A is an isometric view of a wall panel from FIG. 6, in accordance with aspects of the present invention.

In FIG. 6, a rear view of an upright wall panel is shown, which is similar to the top view if the wall panel were facedown, e.g., as in FIGS. 4 and 4A. As is shown in FIG. 6, as each wall panel is lifted, the joint forms 601 are removed, also referred to as joint forms 104 in prior figures.

Each resulting, fully assembled wall has a number of joining wall panels and two end wall panels, depending on wall length and dimensions. End wall panels have a joint side 602 and a finished side 603 and the joining wall panels have two joint sides 602. Each wall panel joint side will have a pattern corresponding to a pattern of the joint side of another wall panel, as created by the joint forms. Therefore, the matching patterns of corresponding joint sides 206 of adjacent wall panel will marry up securely.

As is shown in FIGS. 6 and 6A, the patterns of wall panel joint sides are a zig-zag like pattern 604, in this embodiment, and the structural interlocking key component 605 are created in the wall panel by the joint forms. The structural interlocking key component 605 forms a void in the wall panel end, as well as a path between the void and external surface of two joined wall panels. Once assembled, concrete can be pumped into the path to fill the void and further secure the wall panels together.

Once the wall panels are upright and out of the wall frames, front wall faces are cleaned of any excess sand with pressurized water. The lifting apparatus 501 and crane or similar equipment is used to load the cleaned wall panels onto a flat bed truck for transport to the site for installation.

Wall Installation, Tune-up, and Drainage

Figure 7:
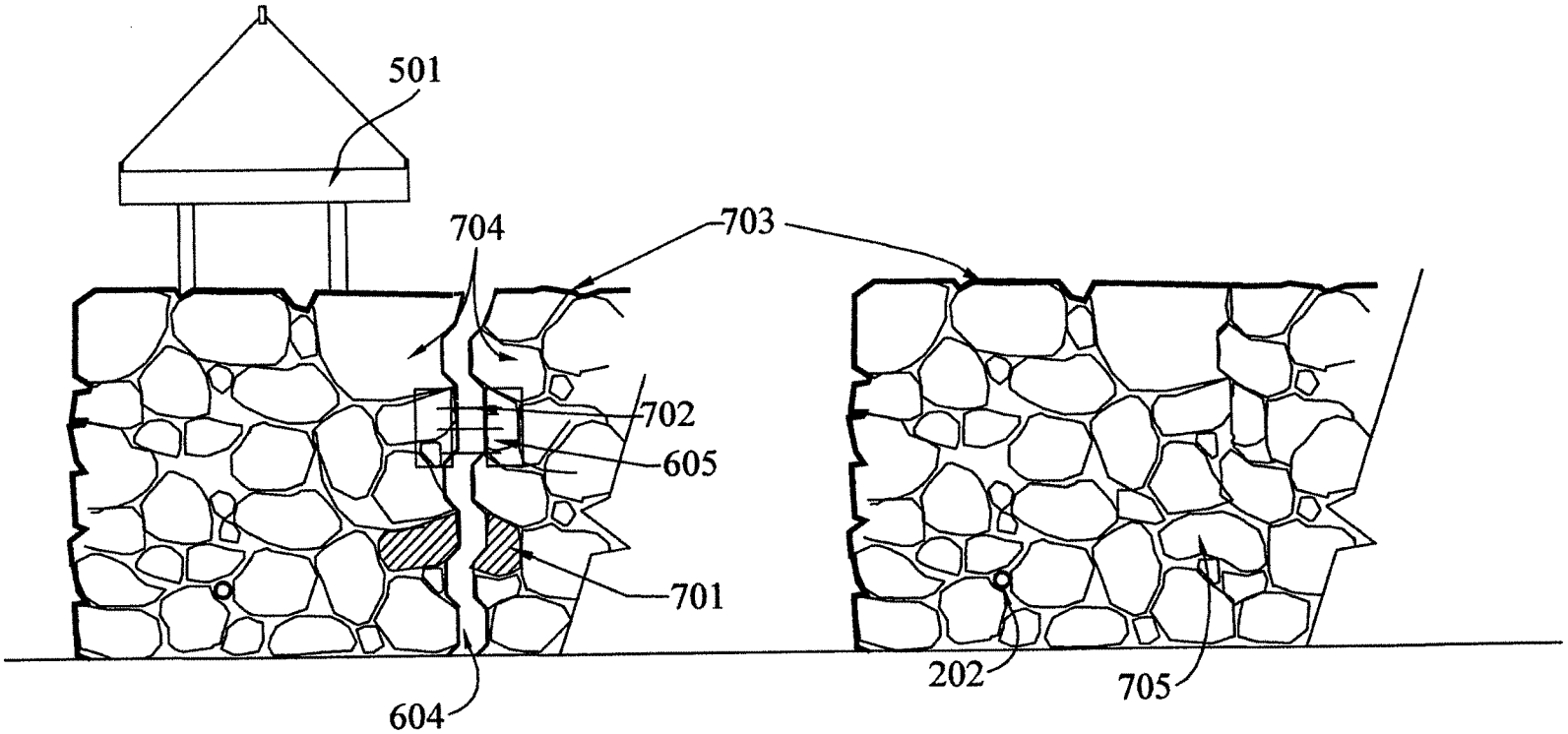
FIG. 7 is a front view of the joining of two wall panels together, in accordance with aspects of the present invention.
Figure 7A:
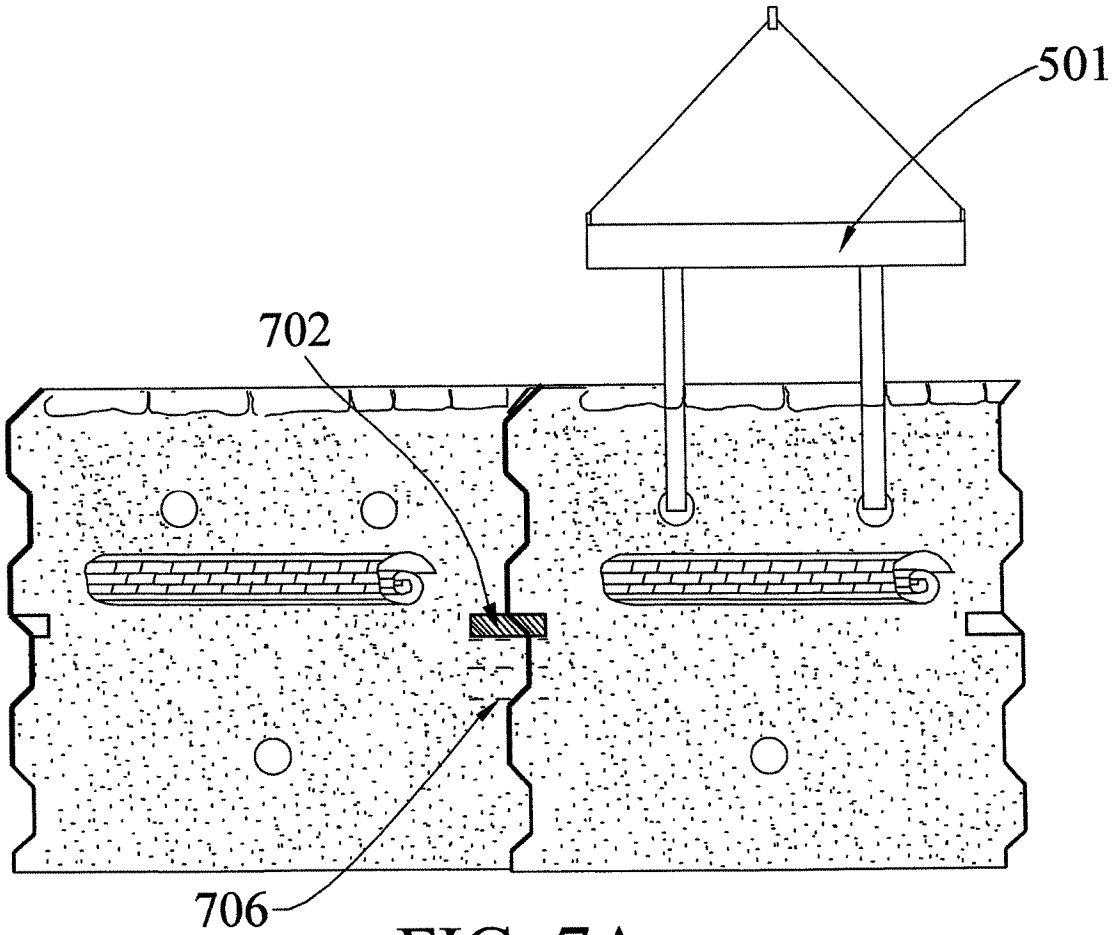
FIG. 7A is a rear view of the joining of two wall panels together, in accordance with aspects of the present invention.

FIG. 7 is a front view of the joining of two wall panels together, in accordance with aspects of the present invention. And FIG. 7A is a rear view of the joining of two wall panels together, in accordance with aspects of the present invention.

In FIG. 7 the Styrofoam placeholders (107 in 1 and 1A) for bridge stones are removed revealing a space 701 where bridge stones will be inserted on-site, when the wall panels are joined together.

At the site, the lifting apparatus 501 and crane are used to unload and move all wall panels to be installed. Wall panels are moved by crane one by one and arranged per design on a proper footing, in the present embodiment. Installers guide the wall panels into place and ensure a close connection between wall panels via the zig-zag like pattern 604 of joint sides.

Once all the wall panels are properly arranged (per design requirements) onto the footing, they are further locked together by placing mortar 702 followed by reinforcing steel rods 706 into the mirrored negative voids created by the structural interlocking key 605 between joint sides of each wall panel. Once the concrete or mortar has cured, a reinforced concrete block is created inside all the connected joint sides, interlocking them together.

Using traditional masonry practices, mortar is placed between the top stones 703 as well as between the side stones 704 of the connecting joint sides for the length of the entire wall to eliminate any appearance of vertical joints where wall panels interconnect. And using traditional masonry practices, pre-selected bridge stones 705 are placed and mortared in the space or shelf 701 created after the placeholders 107 are removed to further eliminate any appearance of a vertical joint.

Figure 8:
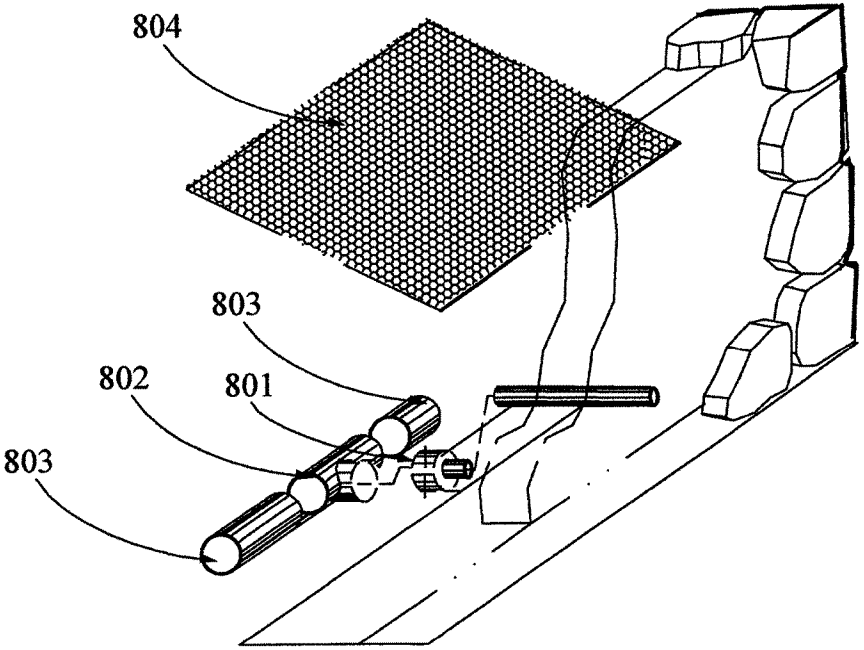
FIG. 8 is a partial exploded view of drainage elements used in a wall panel, in accordance with aspects of the present invention.

FIG. 8 is a partial exploded view of drainage elements used in a wall panel, in accordance with aspects of the present invention. Referring to FIG. 8, the drainage pipes 202 inserted into wall panels in the construction phase (see FIGS. 2-2C) are connected to a perimeter drain to ensure proper drainage and pressure relief behind the installed walls.

In this particular embodiment, a 2" to 4" bushing 801 is installed and a 4" "T" connector 802 is installed onto the bushing and then connected to a 4" perforated perimeter drain 803 that runs parallel to the back of the wall.

The pre-installed geogrid reinforcement 804, referred to as 402 in FIGS. 4 and 4A, is unrolled to be tied into the earth behind the retaining wall, using traditional construction methods. The assembled wall panels are backfilled according to engineering specifications of the wall.

B. Freestanding or Two-Sided Walls

A freestanding or two-sided stone wall can be made when two walls built using the above described method are placed back to back. Wall panels are made thinner than for a retaining wall described above, no drainage or geogrid reinforcement is required and additional placeholders (e.g., Styrofoam) are placed into the forms to create negative voids/spaces for the top joint bridge stones.

Wall Frames, Joint Forms and Placeholders

Figure 9:
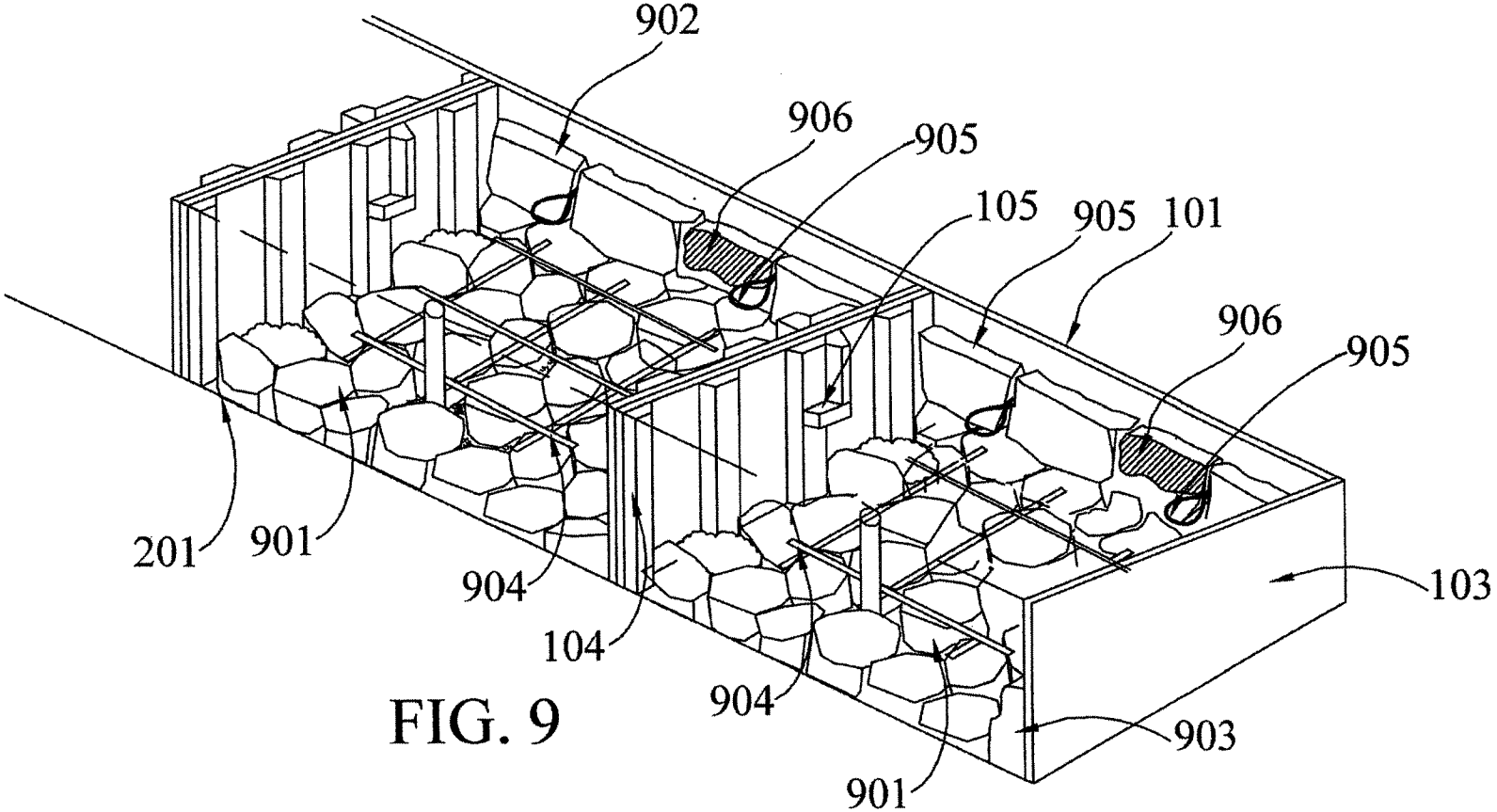
FIG. 9 is top view of an embodiment to a freestanding wall frame having stones and reinforcements added, in accordance with aspects of the present invention.
Figure 10:
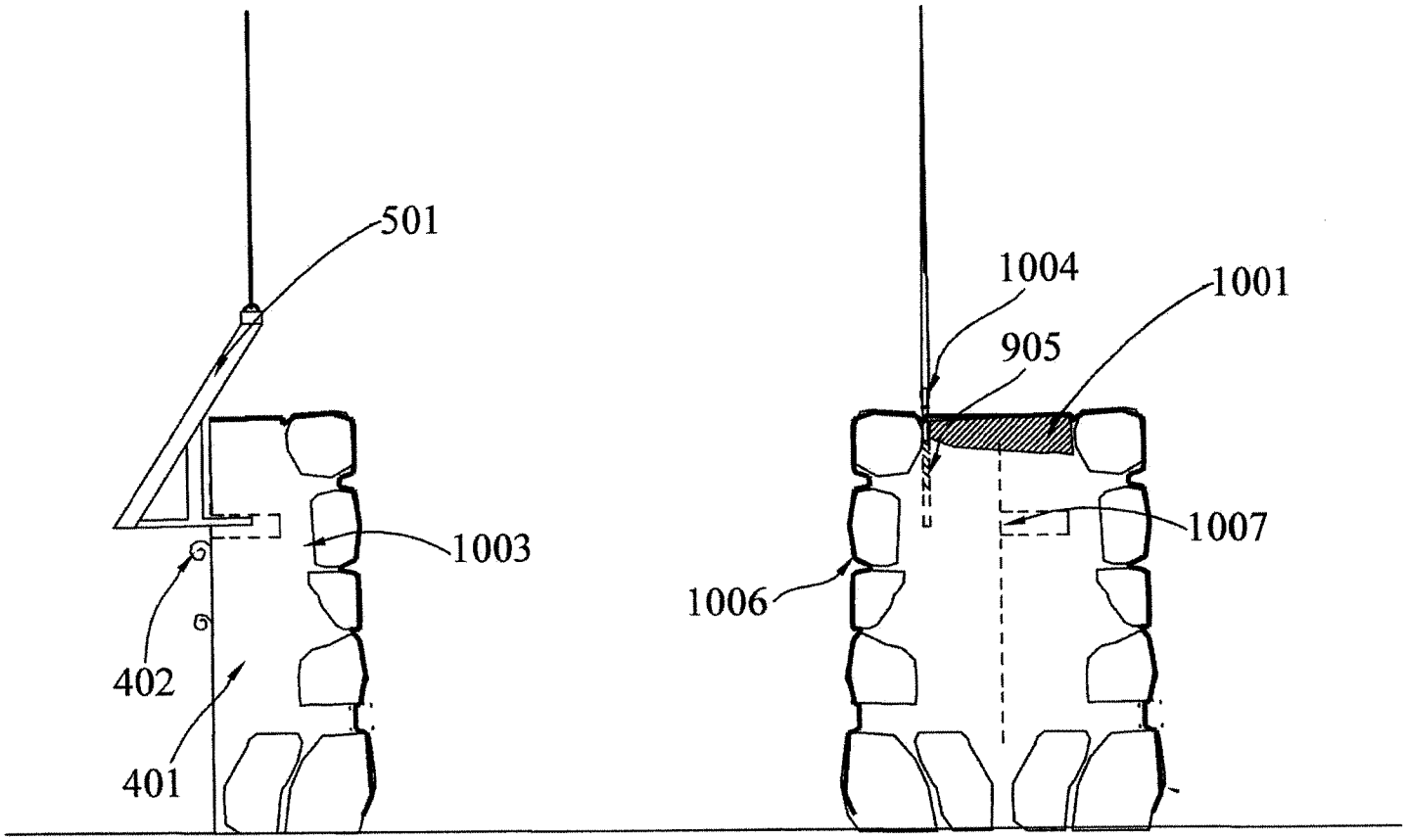
FIG. 10 is a side elevation view of an embodiment to the wall frame of FIG. 9 utilizing flared tie loops and "j" hooks to install wall sections, in accordance with aspects of the present invention.

FIG. 9 is top view of an embodiment to a freestanding wall frame having stones and reinforcements added, in accordance with aspects of the present invention. And FIG. 10 is an isometric view of an embodiment to the wall frame of FIG. 9 having stones and reinforcements added, in accordance with aspects of the present invention.

Figure 1A:
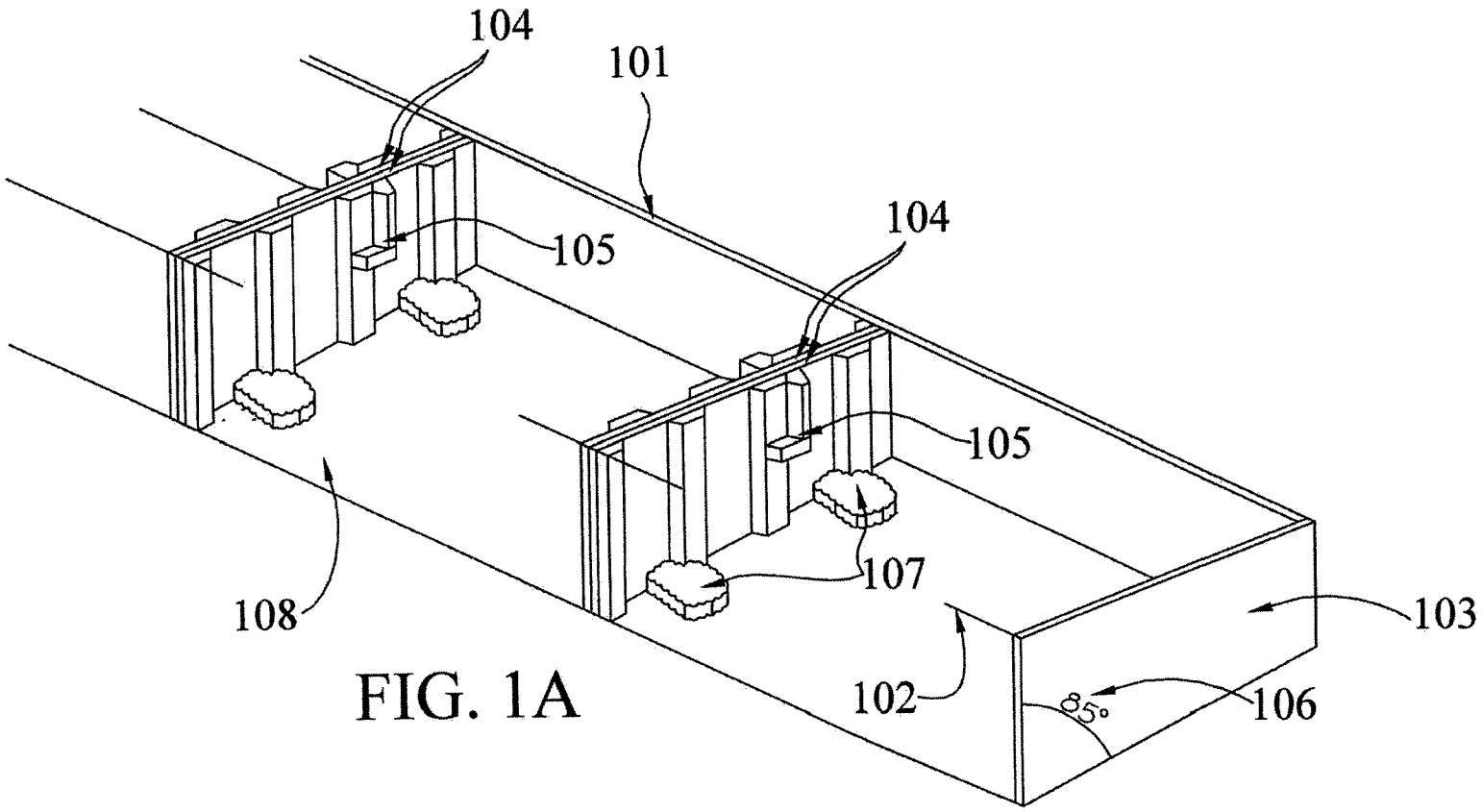
FIG. 1A is an isometric view of an embodiment of the wall frame in FIG. 1, in accordance with aspects of the present invention.

In this embodiment, the description above with respect to FIGS. 1 and 1A substantially applies. However, here joint forms 104 are used to address the structural and aesthetic requirements for a resulting seamless in appearance natural stone freestanding wall. In this embodiment there are no differences in the joint forms between freestanding and retaining walls, the same joint forms can be used for both.

As is shown in FIG. 9, bridge stone placeholders 906 (e.g., Styrofoam blocks or other similar impenetrable material) are placed inside the wall frame adjacent to the joint forms 104 (as before) and adjacent to the top frame 101, according to design where field-set bridge stones will be placed. In FIG. 9, bottom frame 102 is transparent.

Sand and Curves

In this embodiment, the description above with respect to FIGS. 2, 2A, 2B and 2C substantially applies.

Stones, Rebar and Concrete

In this embodiment, the description above with respect to FIGS. 3, 3A, and 4 substantially applies, as well as FIG. 9.

Referring to FIG. 9, natural stones, here face stones 901, top stones 902, and side stones 903, required by wall design are placed into the sand 201 (see FIGS. 2, 2A, 2B and 2C) inside the wall frames 100 (comprising 101, 102, 103, and 104, as in FIGS. 1 and 1A). Face stones 901 are arranged in the sand setting bed 201 (not visible in FIG. 9) that will create the face or front of the resulting wall, top stones 902 are arranged against the top frame 101 that will create natural wall tops and for end wall panels, side stones 903 are arranged against the end frame 103.

Referring to FIG. 10, sand 304 is carefully placed and swept into the joints between the stones per wall design (e.g., dry tucked vs. exposed mortar appearance). Sand in stone joint 304 is washed down and compacted with water to further ensure that the natural joints between stones are even and that the back of each stone is clean to ensure proper adhesion with the concrete to be placed later.

As described with respect to FIGS. 3 and 3A, reinforcing steel grid consisting of #4 rebar rods 904 is placed on top of the face stones 901 and will serve to strengthen and reinforce the concrete to be placed later on.

As is shown in FIG. 9, flared tie loops 905 are temporarily anchored to the frame top 101, so they are buried in later added concrete. Flared tie loops can be made of any suitably strong material; in this embodiment they are made out of solid steel. Then, like with the retaining walls, a 3000-PSI concrete is placed onto the face stones 901 and rebar rods 904 to a depth of 6-8 inches to create the concrete backing 401 of resulting walls, see FIGS. 4 and 10. Simultaneously with concrete placement (i.e., at least before the curing process is complete), geotextile fabric or geogrid 402 is anchored into the wet concrete and will function as an interlocking grid holding the two internal (or rear) wall faces together. The geogrid 402 is cut to a length of 3"-4", in this embodiment.

Also simultaneously with concrete placement (i.e., at least before the curing process is complete), 2" schedule 40 PVC conduit pipes with one sealed end 403 are inserted at least 6 inches into the wet concrete backing 401 of each wall panel and will serve as insert holes for lifting apparatus. As above, a concrete vibrator can be used to ensure a proper concrete consolidation and adhesion to the stones in the forms. The consolidated concrete that forms the concrete backing 401 of the walls is then left to cure in the forms for the required proper curing time as specified by concrete manufacturer.

Wall Reveal, Load, and Transport

In this embodiment, the description above with respect to FIGS. 5, 6, 6A, 7, and 7A substantially applies with respect to Wall Reveal, Load, Transport, as well as FIG. 10. As described above, after the concrete has fully cured, the perimeter frame (comprising frame top 101, frame bottom 102, and frame ends 103) is removed to reveal the stone wall panels. In the freestanding wall embodiment, the tie loop holders are removed with the frame top leaving the now exposed flared tie loops to be connected with eyehooks for installation later.

The lifting apparatus 501 is inserted into the pre-installed insert pipes 502. And the lifting apparatus 501 is attached to a crane or similar equipment that lifts and flips each wall panel so that the front of the wall becomes exposed, as described above. As each wall panel is lifted, the joint forms 104 (or 601 in FIGS. 6 and 6A) are removed.

Referring to FIGS. 6 and 6A, each resulting wall has a number (depending on wall length and dimensions) of joining wall panels and two end wall panels. End wall panels have a joint side 602 and a finished side 603 and the joining wall panels have two joint sides 602. Wall panel joint sides have a zig-zag like pattern 604 and the structural interlocking key component 605 created by the joint forms. Each wall panel joint side will have a matching or mirrored joint side of another wall panel as created by the joint forms.

The placeholders 107, 906 for bridge stones are removed from front and top of wall panels revealing spaces 701 and 1001 where bridge stones will be placed during installation, on-site. Front wall faces are cleaned of any excess sand with pressurized water. The lifting apparatus 501 and crane or similar equipment is used to load the cleaned wall panels onto a flat bed truck for transport to the installation site.

Wall Installation and Tune-up

Referring to FIG. 10,

Referring to FIG. 10, the lifting apparatus 501 and crane are used to unload and move wall panels. Wall panels are moved by crane one-by-one and arranged per design on a proper footing to create the first half of wall or first wall face 1003.

In this embodiment, eye hooks 1004 are inserted into the pre-installed flared tie loops 905 and attached to a crane or similar equipment to move and install the second half of the wall or the second wall face 1006 back-to-back with the first half of wall leaving a space of about one inch.

Once all the wall panels and both sides of wall are properly arranged (per design requirements) onto the footing, the two wall faces are locked together by placing high strength mortar 1007 into the space between the two wall faces.

Using traditional masonry practices, mortar is placed between the side stones 704 of the connecting joint sides to eliminate any appearance of a vertical joint, see FIG. 7. Pre selected bridge stones 705 are placed and mortared in the space 701 created after removal of Styrofoam placeholders 107 to further ensure a seamless appearance, as discussed above.

Using traditional masonry practices, bridge stones are placed and mortared in the corresponding voids in top of wall 1001 created after removal of Styrofoam placeholders 906 to create a natural stone top without the use of a cap stone.

While the foregoing has described what are considered to be the best mode and/or other preferred embodiments, it is understood that various modifications can be made therein and that the invention or inventions may be implemented in various forms and embodiments, and that they may be applied in numerous applications, only some of which have been described herein. It is intended by the following claims to claim that which is literally described and all equivalents thereto, including all modifications and variations that fall within the scope of each claim.

What is claimed is:

1. A method of forming and providing at least one wall panel having a natural stone face and top, the method comprising:

providing an open-back wall frame in a facedown position, the wall frame having a face portion, a frame top, a frame bottom opposite the frame top, and at least two frame ends, with at least one frame end comprising a joint form that defines a back-to-front pattern of alternating lateral protrusions and indentations used to form a joint side of the wall panel;

inserting at least one removable placeholder against the face portion and the joint form;

layering a sand setting bed onto the face portion and around the at least one removable placeholder:

layering natural stones onto the sand setting bed around the at least one removable placeholder, including arranging stones in the sand setting bed to create a natural stone face and arranging stones against the frame top in create a natural stone top;

pouring concrete onto the natural stones in the wall frame;

setting first and second lifting tubes to a partial depth into the concrete so that the first and second lifting tubes remain accessible from a rear face of the wall panel after the concrete has cured;

curing the concrete;

inserting first and second bottom holder members of a rigid lifting apparatus into the first and second lifting tubes of the wall panel, the lifting apparatus including a cable connection; and applying a substantially upward vertical force on the cable connection of the lifting apparatus, thereby flipping the wall panel oat of the wall frame from the facedown position to an upright position.

2. The method of claim 1, further comprising:

inserting at least one drain pipe into the sand setting bed prior to layering the natural stones, the drain pipe extending from the face portion of the wall panel to the open back of the wall frame.

3. The method of claim 2, further comprising:

installing the wall panel in an upright position and attaching a drainage system to the at least one drain pipe.

4. The method of claim 1, further comprising:

adding a strengthening and reinforcing steel grid of rebar rods within the wall frame and on the natural stones before curing the concrete; and submerging a portion of a geotextile or geogrid fabric into the concrete before the concrete cures, the geotextile or geogrid fabric extending beyond the rear face of the wall panel after the curing of the concrete.

5. The method of claim 1, wherein the at least one cable connection is disposed above the natural stone top of the wall panel when the wall panel is suspended from the lifting apparatus.

6. The method of claim 1, wherein the joint form comprises a structural interlocking key component pattern and the method includes:

the cured concrete forming an interlocking key void in the joint side of the wall panel as well as at least a portion of a path between the interlocking key void and the rear face of the wall panel.

7. The method of claim 1, further comprising forming the wall panel to have a curved face, including:

inserting a wedge adjacent to the joint form; and radiusing the sand setting bed into a concave shape or a convex shape to form the wall panel having a convex face or a concave face, respectively.

8. The method of claim 1, wherein the pattern of alternating lateral protrusions and indentations is a zig-zag pattern.

9. The method of claim 1, further comprising:

slideably inserting top and bottom ends of the joint form into joint form channels respectively provided at the frame top and the frame bottom of the wall frame.

10. The method of claim 1, wherein the natural stone wall is a retaining wall.

11. The method of claim 1, the method further comprising combining the wall panel, as a first wall panel, with a second wall panel so the combination has a seamless appearance, including:

removing the at least one removable placeholder from against the joint form to reveal a first placeholder void in the joint side of the first wall panel;

abutting the joint side of the first wall panel with a second joint side of the second wall panel, the second joint side including a corresponding second back-to-front pattern of lateral protrusions and indentations and second place holder void that marry with the back-to-front pattern of lateral protrusions and indentations and first placeholder void of the first wall panel; and joining the first and second wall panels together at an installation site, including:

mortaring between side stones of the connecting first and second wall panel joint sides for a length of an entire wall joint to eliminate an appearance of a vertical joint where the first and second wall panels interconnect;

further eliminating an appearance of such vertical joint by mortaring a bridge stone into a shelf formed by the first and second placeholder voids.

12. The method of claim 1, wherein the lifting apparatus is a unitary lifting apparatus that includes:

a first end including the cable connection and a second end including the first and second bottom holder members;

at least one top holder member that extends between the first and second ends and, wherein the first and second bottom holder members extend from the at least one top holder member, and wherein an angle between the at least one top holder member and the first and second bottom holder members is less than 90 degrees; and at least one bridging member disposed between the at least one top holder member and the first and second bottom holder members.

13. The method of claim 1, wherein flipping the wall panel out of the wall frame from the facedown position to an upright position is accomplished without the lifting apparatus contacting the natural stone top or the natural stone face of the wall panel.

14. The method of claim 1, wherein inserting the first and second bottom holder members into the first and second lifting tubes of the wall panel includes sliding the first and second bottom holder members into the first and second lifting tubes of the wall panel.

15. A method of forming a stone wall, comprising:

forming a first wall panel and a second wall panel, each wall panel having a natural stone face, a natural stone top, first and second lifting tubes set to a partial depth of the wall panel that are accessible from a rear face of the wall panel, and at least one joint side comprising a front-to-back zig-zag pattern of lateral protrusions and indentations and an interlocking key void, and at least one bridge stone void at the joint side including:

forming a first interlocking key void in a first joint side of the first wall panel;

forming a second interlocking key void in a second joint side of the second wall panel that is arranged to align with the first interlocking key void of the first joint side, forming a path from at least one of the first and second interlocking key voids to an external surface of the rear face of at least one of the first and second wall panels;

providing a unitary lifting apparatus having a first end with a cable connection and a second end having elongated first and second bottom holder members corresponding to the first and second lifting tubes; and joining the first and second wall panels together at an installation site, including:

moving the first and second wall panels onto footings at the installation site using the lifting apparatus, including abutting the first and second wall panels via the zig-zag pattern of their respective joint sides, aligning the at least one bridge stone void of the first and second wall panels to form a shelf, and aligning the interlocking key void of the first and second wall panels;

locking together the joint sides of the first and second wall panels, including after abutting the first joint side of the first wall panel with the second joint side of the second wall panel, pumping concrete via the path into a complete interlocking key void formed from the first and second interlocking key voids within the abutted first and second wall panels;

mortaring at least one bridge stone into the shelf, wherein for each of the first and second wall panels;

moving the wall panels includes inserting the first and second bottom holder members into the first and second lifting tubes of the wall panel and applying a substantially upward vertical force on the cable connection of the lifting apparatus, thereby causing the wall panel to be flipped from the facedown position to an upright position, with the cable connection of the lifting apparatus not contacting the natural stone top of the suspended wall panel.

16. The method of claim 15, wherein forming at least one of the first and second wall panels includes:

providing a wall frame as a box having an open back, the wall frame having a face portion, a frame top, a frame bottom opposite the frame top, and at least two frame ends, including placing the wall frame in a facedown position;

inserting a joint form into the wall frame configured to form the pattern of front-to-back lateral protrusions and indentations;

layering a sand setting bed into the wall frame;

inserting at least one removable placeholder against the joint form and at least one removable placeholder against the joint form and the frame top;

layering natural stones onto the sand setting bed, including arranging face stones in the sand setting bed on the face portion and around the removable placeholders to create a natural stone face of the resulting wall, and arranging top stones against the frame top to create a natural stone wall top; and pouring concrete into the wall frame.

17. The method of claim 16, wherein inserting the joint form into the wall frame includes:

slideably inserting top and bottom ends of the joint form into joint form channels respectively provided at the frame top and frame bottom.

18. The method of claim 16, further comprising:

inserting at least one drain pipe into the sand setting bed prior to layering the natural stones, the drain pipe extending from the face of the wall panel to at least the open back of the box.

19. The method of claim 18, further comprising:

after abutting the first and second wall panels, attaching a drainage system to the at least one drain pipe.

20. The method of claim 16, further comprising:

before pouring concrete into the wall frame, adding a strengthening and reinforcing steel grid of rebar rods within the wall frame and on the natural stones.

21. The method of claim 20, further comprising:

after pouring concrete into the wall frame and before the concrete fully cures, submerging a portion of a geotextile or geogrid fabric into the concrete, the geotextile or geogrid fabric extending beyond the rear face of the wall panel after the concrete fully cures.

22. The method of claim 16, further comprising forming at least one of the first and second wall panels to have a curved face, including:

inserting a wedge adjacent to the joint form; and radiusing at least a portion of the sand setting bed into at least one of a concave or a convex shape to form a wall panel having a convex face or a concave face, respectively.

23. The method of claim 15, wherein each lifting tube has a sealed end inserted into the concrete and an open end that remains accessible from the rear face of the wall panel.

24. The method of claim 15, further comprising removing the wall panel from the wall frame using the lifting apparatus, including:

inserting the first and second bottom holder members of the first and second lifting apparatus into the lifting tubes while the wall panel is in the wall frame in the facedown position; and applying the substantially upward vertical force on the cable connection of the lifting apparatus thereby simultaneously flipping upright and lifting the wall panel out of the facedown wall frame until the wall panel is suspended upright with the at least one cable connection disposed above the wall panel.

25. The method of claim 15, wherein the natural stone wall is a retaining wall.

26. The method of claim 15, wherein the natural stone wall is a two-side wall and the method includes:

forming the first wall panel to have a first panel top bridge stone void;

forming a third wall panel having a natural stone face, natural stone top, a third joint side comprising a pattern of front-to-back lateral protrusions and indentations and at least one bridge stone void, and a third panel top bridge stone void configured to mate with the first panel top bridge stone void to form a combined top bridge stone void of the first and third wall panels; and installing the third wall panel back-to-back with the first wall panel so that the natural stone faces of the first and third wall panels are externally facing, including securing a bridge stone in the combined top bridge stone void of the first and third wall panels.

27. The method of claim 26, further comprising:

forming the second wall panel to have a second panel top bridge stone void;

forming a fourth wall panel having a natural stone face, natural stone top, a fourth joint comprising a pattern of front-to-back lateral protrusions and indentations and at least one bridge stone void configured to mate with the third joint side of the third wall panel, and a fourth panel top bridge stone void configured to mate with the second panel top bridge stone void to form a second combined top bridge stone void of the second and fourth wall panels;

installing the fourth wall panel back-to-back with the second wall panel so that the natural stone faces of the second and fourth wall panels are externally facing, including abutting the fourth joint side of the fourth wall panel with the third joint side of the third wall panel and securing another bridge stone in the combined top bridge stone void of the second and fourth panels.

28. A method of forming a wall panel having a natural stone face and natural stone top, the method comprising:

providing an open-back wall frame having a face portion, a frame top, a frame bottom opposite the frame top, and at least two frame ends, at least one frame end comprising a joint form configured to form a joint side of the wall panel having a back-to-front pattern of lateral protrusions and indentations and an interlocking key configured to form an interlocking key void in the wall panel end and a path between the interlocking key void and an external surface at a rear face of the wall panel;

inserting a removable joint side placeholder against the face portion and the joint form and a removable top placeholder against the frame top;

layering a sand setting bed on the face portion and around the joint side and top removable placeholders;

layering natural stones onto the sand setting bed, including arranging stones in the sand setting bed around the removable placeholders and on the face portion of the wall frame and against the frame top;

pouring concrete into the wall frame;

setting first and second lifting tubes to a partial depth into the concrete so that the first and second lifting tubes remain accessible from the rear face of the wall panel after the concrete has cured; and curing the concrete, thereby forming the natural stone wall panel including:

the natural stone face;

the natural stone top;

at least one joint side having the back-to-front pattern of alternating lateral protrusions and indentations, the interlocking key void, and the path between the interlocking key void and the external surface at the rear face of the wall panel conforming to the at least one joint form;

placeholder voids defined by the removable joint side and top placeholders; and the first and second lifting tubes configured to insertably receive elongate first and second bottom holder members of a rigid lifting apparatus.

29. The method of claim 28, further comprising forming the wall panel to have a curved face, including:

inserting a wedge adjacent to the at least one joint form; and radiusing the sand setting bed into a concave shape or a convex shape to form the wall panel having a convex face or a concave face, respectively.

30. The method of claim 28, further comprising:

removing the wall panel from the wall frame using the lifting tubes, including:

providing a unitary lifting apparatus having a first end with a cable connection and a second end having the first and second bottom holder members corresponding to the first and second lifting tubes;

sliding insertion ends of the bottom holder members of the lifting apparatus into the lifting tubes; and applying a substantially upward vertical force on the at least one cable connection of the lifting apparatus, thereby simultaneously lifting and flipping upright the wall panel from the face down position so that the lifted wall panel is suspended upright from the lifting apparatus and the cable connection is disposed above a top of the wall panel.

31. The method of claim 28, further comprising:

before filling the wall frame with concrete, adding a strengthening and reinforcing steel grid of rebar rods within the wall frame and on the natural stone; and submerging a portion of a geotextile or geogrid fabric into the concrete before the concrete cures, the geotextile or geogrid fabric extending beyond the rear face of the wall panel after the curing of the concrete.

* * * * *